US008567530B2

(12) United States Patent
Barbera

(10) Patent No.: US 8,567,530 B2
(45) Date of Patent: Oct. 29, 2013

(54) COLLAPSIBLE ROCK HEAD AND ASSOCIATED STRUCTURE

(76) Inventor: James S. Barbera, Bolivar, OH (US)

( * ) Notice: Subject to any disclaimer, the term of this patent is extended or adjusted under 35 U.S.C. 154(b) by 509 days.

(21) Appl. No.: 12/830,481

(22) Filed: Jul. 6, 2010

(65) Prior Publication Data

US 2011/0209921 A1 Sep. 1, 2011

Related U.S. Application Data

(60) Provisional application No. 61/308,472, filed on Feb. 26, 2010.

(51) Int. Cl.
*E21B 7/28* (2006.01)

(52) U.S. Cl.
USPC ..... 175/273; 175/263; 175/384

(58) Field of Classification Search
USPC ..... 175/263, 342, 355, 384, 279, 274, 273, 175/382, 286; 299/80.1, 61
See application file for complete search history.

(56) References Cited

U.S. PATENT DOCUMENTS 2,719,699 A * 10/1955 Baker ..... 175/267
3,545,811 A 12/1970 Montacie
3,561,550 A 2/1971 Mays
3,583,503 A 6/1971 Coski
3,837,413 A 9/1974 Dunn
3,934,660 A 1/1976 Nelson
5,314,267 A 5/1994 Osadchuk
5,711,385 A 1/1998 Brotherton
6,206,109 B1 3/2001 Monier et al.
6,439,321 B1 * 8/2002 Gillis et al. ..... 175/73
7,367,412 B2 5/2008 Barbera et al.
2004/0222022 A1 * 11/2004 Nevlud et al. ..... 175/57

FOREIGN PATENT DOCUMENTS

JP 2001049989 A * 2/2001

* cited by examiner

*Primary Examiner* — Kenneth L Thompson
*Assistant Examiner* — Ronald Runyan
(74) *Attorney, Agent, or Firm* — Sand & Sebolt

(57) ABSTRACT

A collapsible cutter bit or rock head for use with an underground auger boring machine has an expanded position for cutting rock in front of an underground pipe and a collapsed position for withdrawing the rock head through the underground pipe. The auger boring machine is configured to bore a passage through a body of soil and rock and simultaneously lay the underground pipe in the passage. Forward rotation of the cutter bit causes expansion while collapse of the cutter bit may be driven by reverse rotation of the cutter bit or another mechanism.

21 Claims, 21 Drawing Sheets

COLLAPSIBLE ROCK HEAD AND ASSOCIATED STRUCTURE

CROSS REFERENCE TO RELATED APPLICATIONS

This application claims priority from U.S. Provisional Application Ser. No. 61/308,472 filed Feb. 26, 2010; the disclosure of which is incorporated herein by reference.

BACKGROUND OF THE INVENTION

1. Technical Field

This invention generally relates to underground boring equipment. More particularly, the invention relates to a cutting head for use with an auger boring machine to bore through a body of soil and simultaneously lay an underground pipe. Specifically, the invention relates to a collapsible rock head which cuts rock forward of the underground pipe when expanded and which may be collapsed so that it can pass through the pipe.

2. Background Information

The use of auger boring machines to lay underground pipe without causing damage to surface structures such as roadways is well known. In this procedure, the boring machine is used to form a generally horizontal hole or passageway through the soil at an appropriate depth. The boring machine may be positioned adjacent a hillside for boring into the hillside or an excavation pit may be dug in the ground to accommodate the boring machine at the appropriate boring depth. The boring machine is typically mounted on tracks so that it is able to slide toward and away from the surface into which the hole is being bored. Once the boring machine is in position, a flighted auger is operationally connected to the boring machine and an appropriate cutting head is attached to the front of the auger. The cutting head is placed into contact with the soil face and the auger and cutting head are rotated by the boring machine so that the cutting head bores into the soil while the helical auger flights direct excavated material away from the cutting head and out of the hole. Additional sections of auger are added as needed by sliding the boring machine away from the hole, positioning a new auger section rearwardly of the first auger section typically using a crane, and then securing the auger sections together. The boring machine is advanced forward along the tracks toward the soil face until the next auger section is needed, and then another auger section is attached thereto. This procedure is repeated until the desired length of hole is cut through the soil.

When laying the pipe at the same time as excavating the hole or passageway, each section of auger is inserted into a section of casing or pipe before it is lowered into place in front of the boring machine. The boring machine then advances both the pipe and auger as the cutting head cuts through the soil. The machine pushes the pipe through the soil substantially without rotation while rotating the auger within the pipe. Subsequent sections of auger and pipe are connected as needed. The sections of auger are connected together typically using male and female hex connectors. The sections of pipe are secured together by welding.

The cutting head selected for boring operations is dependent upon the type of substrate that is being drilled. If the substrate is generally soil with small stones interspersed therethrough, then the type of cutting head used is known as a dirt head. Dirt heads cut easily and efficiently through soil. During boring operations, the dirt head sometimes strikes a large rock or a layer of rock. Dirt heads are ill equipped to cut through rock. Rock heads are specially designed to cut through rock, but are far less efficient at cutting through soil.

It used to be a very time consuming process to replace the dirt head with a rock head to cut through the rock, as detailed in U.S. Pat. No. 7,367,421 granted to Barbera et al. Said patent describes a collapsible rock head used in overcoming such time consuming processes. Generally, Barbera et al. describes the method of cutting appropriate substrate with a dirt head until it encounters a large rock or rock layer, at which time the dirt head and auger are withdrawn through the underground pipe so that the dirt head may be replaced with a collapsible rock head. The rock head and auger are then be inserted and advanced through the pipe such that the rock head automatically expands pivotally mounted rock cutters via spring bias to an expanded position forward of the pipe in order to cut through the rock a hole of sufficient diameter to allow the pipe to be inserted therethrough.

Although collapsible rock heads are known generally, there is still a need in the art for improved collapsible rock heads, such as provided by the present invention.

SUMMARY OF THE INVENTION

The present invention provides an apparatus comprising: a cutter bit which has front and rear ends defining therebetween an axial direction and which rotates during operation about an axis which extends in the axial direction; the cutter bit adapted to rotate within an underground casing having a cylindrical inner surface of a first inner diameter; a base of the cutter bit; a plurality of rock cutters configured for cutting rock when the cutter bit is rotated about the axis; and a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position.

The present invention also provides an apparatus comprising: a cutter bit which has front and rear ends defining therebetween an axial direction and which rotates during operation about an axis which extends in the axial direction; the cutter bit adapted to rotate within an underground casing having a cylindrical inner surface of a first inner diameter; a drive section of the cutter bit; a base of the cutter bit; a plurality of rock cutters configured for cutting rock when the cutter bit is rotated about the axis; a plurality of movable cutter mounts each of which is mounted on the base, carries one of the cutters and is movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position; a plurality of circumferentially elongated first cam surfaces; a plurality of second cam surfaces; and a sliding engagement between the first cam surfaces and the second cam surfaces respectively during rotation of the drive section relative to the base about the axis which causes the movable cutter mounts to move radially.

The present invention further provides an apparatus comprising: a cutter bit which has front and rear ends defining therebetween an axial direction and which rotates during operation about an axis which extends in the axial direction; the cutter bit adapted to rotate within a cylindrical casing having a cylindrical inner surface of a first inner diameter; a plurality of rock cutters configured for cutting rock when the cutter bit is rotated about the axis; a base of the cutter bit; a plurality of movable cutter mounts each of which is mounted on the base, carries one of the cutters and is movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position; a plurality of radially elongated keyways defined by one of (a) the base and (b) the cutter mounts respectively; and a plurality of keys formed on the other of the base and the cutter mounts respectively so that each key is radially slidable within a respective one of the keyways during movement of the cutter mounts between the collapsed and expanded positions.

BRIEF DESCRIPTION OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
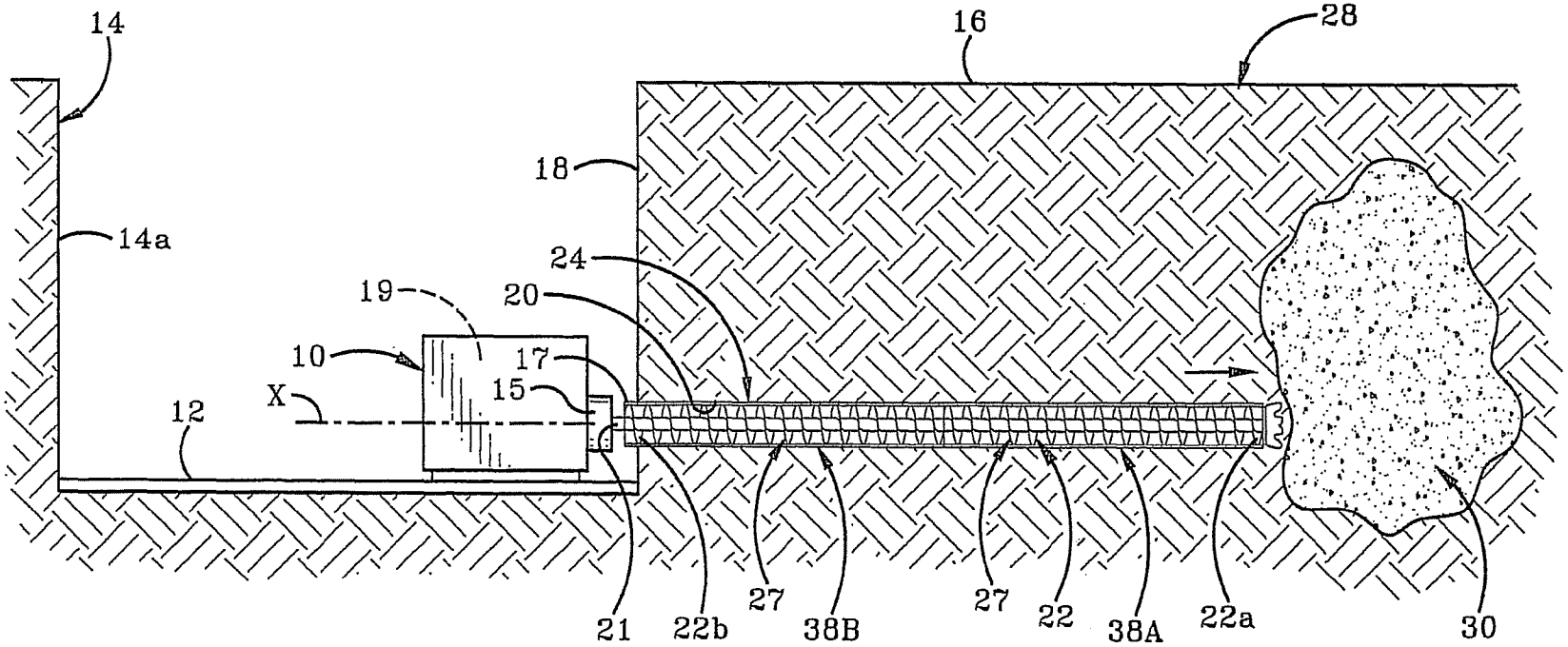
FIG. 1 is a side elevational view showing a boring machine equipped with a dirt head encountering an underground rock.

Referring to FIG. 1, there is shown a boring machine 10 mounted on tracks 12 within an excavation pit 14 having a back side 14A and a front side or soil face 18. Pit 14 extends for a depth below the ground surface 16 and exposes soil face 18 into which a hole 20 is being bored. The boring is accomplished by a dirt head 26 that is attached to a front or leading end 22A of a flighted auger 22. Auger 22 is operationally connected to boring machine 10 and extends through the bore 32 of an underground casing or pipe 24. Boring machine 10 advances both the auger 22 and pipe 24 through the soil 28 within hole 20. Auger 22 is formed by connecting in an end-to-end fashion a series of auger segments such as a lead auger segment 27 and a trailing auger segment 27.

More particularly, machine 10 includes a rigid frame which is slidable back and forth on tracks 12 and has mounted thereon a pushing member 15 for engaging the rear end 17 of pipe 24 and pushing pipe 24 non-rotationally forward, and a drive motor 19 having a rotational output or drive 21 which rotationally engages a rear or trailing end 22*b* of auger 22 via a torque drive connection for rotating auger 22 within pipe 24 and consequently rotating dirt head 26 to bore through dirt and other soil which may be appropriately cut by dirt head 26. During operation, drive 21, auger 22 and dirt head 26 rotate about a generally horizontal axis X, which also serves as the center of pipe 24 extending from one end thereof the other end thereof. Pipe 24 has a cylindrical inner surface 24*a* (FIGS. 2, 17, 21) which is concentric about axis X and has an inner diameter D1, and a cylindrical outer surface 24*b* which is concentric about axis X and has an outer diameter D2 which is larger than diameter D1 by twice the thickness of the cylindrical wall of pipe 24.

Figure 4:
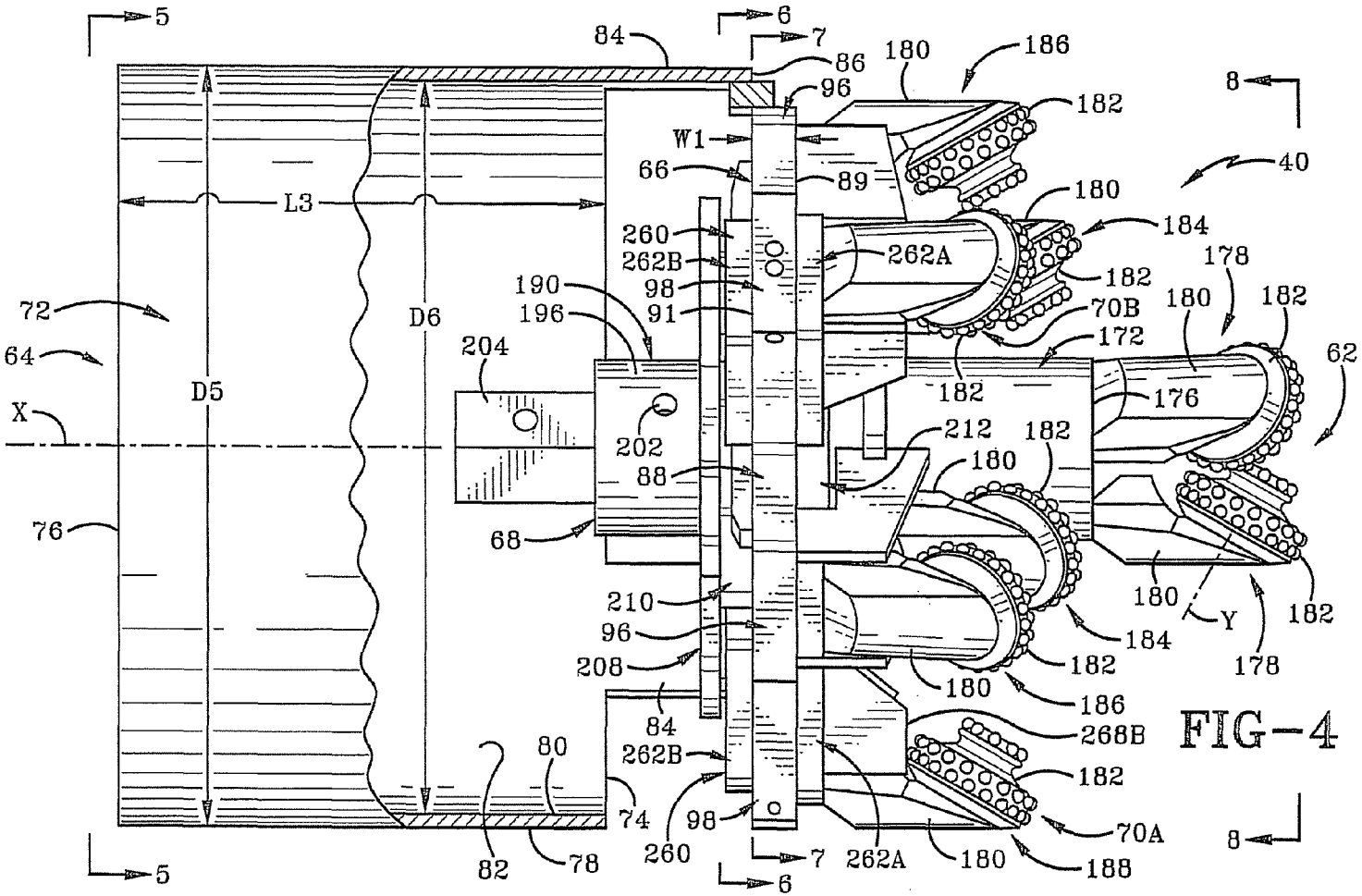
FIG. 4 is a side elevational view of the collapsible rock head of the present invention in the collapsed position.

FIG. 1 shows that a large-bodied rock 30 lies in the path of the dirt head 26. Inasmuch as the dirt head 26 is not suitable for boring through hard substances such as rock, dirt head 26 is be replaced with a rock head 40 of the present invention, which is shown in FIG. 4. The soil excavated by dirt head 26 is carried rearwardly by auger 22 from adjacent dirt head 26, front end 22*a* and the front or leading end of pipe 24 toward rear end 22*b* and the rear or trailing end of pipe 24 so that auger 22 pushes the excavated soil rearwardly out of the rear end of pipe 24 into pit 14 adjacent machine 10 for subsequent removal from pit 14 by equipment not shown.

Figure 2:
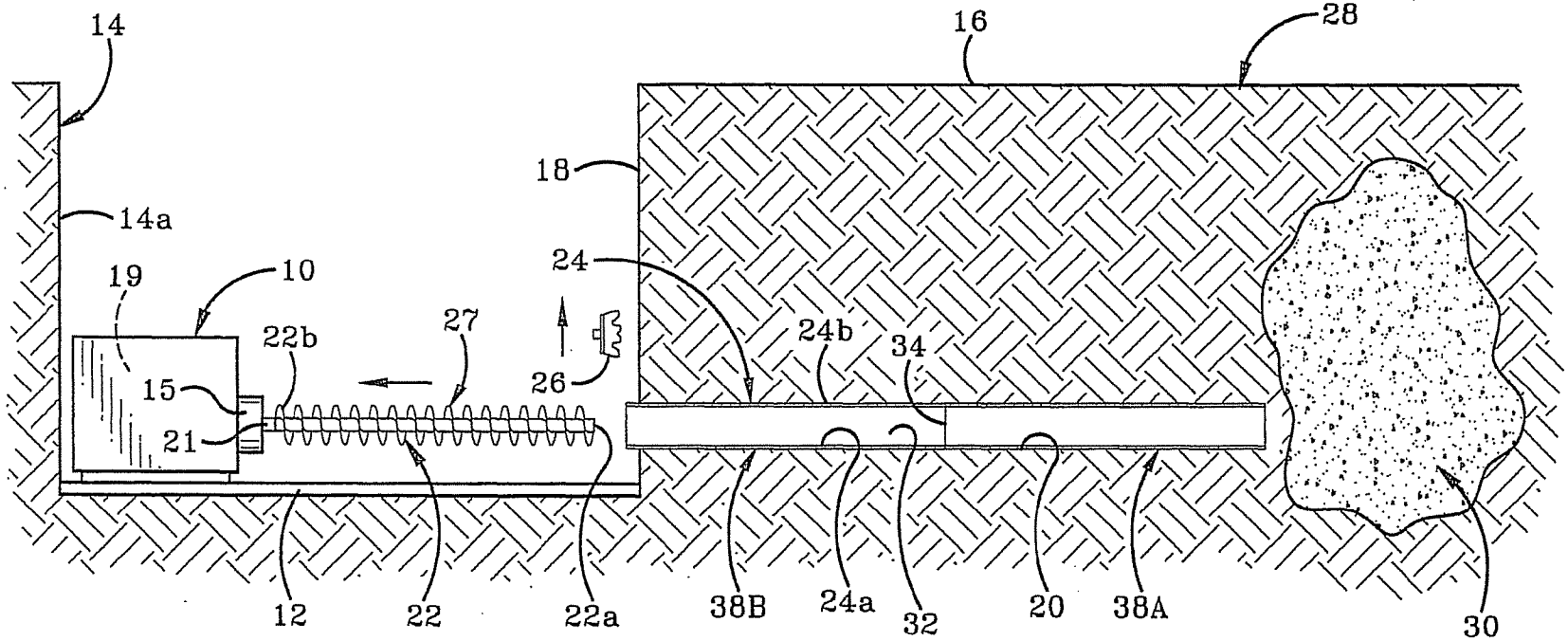
FIG. 2 is a side elevational view showing the boring machine with the auger and dirt head extracted out of the pipe and with the dirt head removed.

In order to replace dirt head 26 with a cutting head suitable for cutting through the rock 30, the auger 22 and dirt head 26 are withdrawn from within bore 32 of pipe 24. FIG. 2 shows how boring machine 10 is slidably moved rearwardly on tracks 12 toward the back side of excavation pit 14 and remote from soil face 18. As boring machine 10 moves rearwardly, it draws or pulls auger 22 and dirt head 26 rearwardly and out of bore 32 of pipe 24 so that auger 22 and dirt head 26 are completely withdrawn from pipe 24. The figure also shows that pipe 24 comprises a plurality of sections, such as first and second pipe sections or segments 38A-B that are connected end-to-end by a weld 34 such that first pipe segment 38A serves as a leading pipe section or segment of pipe 24. Once auger 22 and dirt head 26 are fully withdrawn from pipe 24, dirt head 26 is detached from the front end 22*a* of auger 22. A modified lead auger segment 25 (FIG. 3) is then attached to the front of the auger where dirt head 26 was attached, as discussed in more detail further below.

Collapsible rock head or cutter bit 40 is then attached to front end of auger 22 (so that lead auger segment 25 and rock head 40 replace dirt head 26), after which rock head 40 and auger 22 are inserted into pipe 24 and pushed forward therethrough so that rock head 22 extends forward of the front end of pipe 24, and drive motor 19 powers the rotation of drive 21 to rotate auger 22 and rock head 40 so that rock head 40 cuts a hole through rock 30. As explained in greater detail further below, rotation of drive 21 and auger 22 causes rock head 40 to move from its collapsed position (FIGS. 4-8, 11, 14-16) to its expanded position (FIGS. 17-21) after rock head 40 is pushed forward of the front end of pipe 24.

Figure 3:
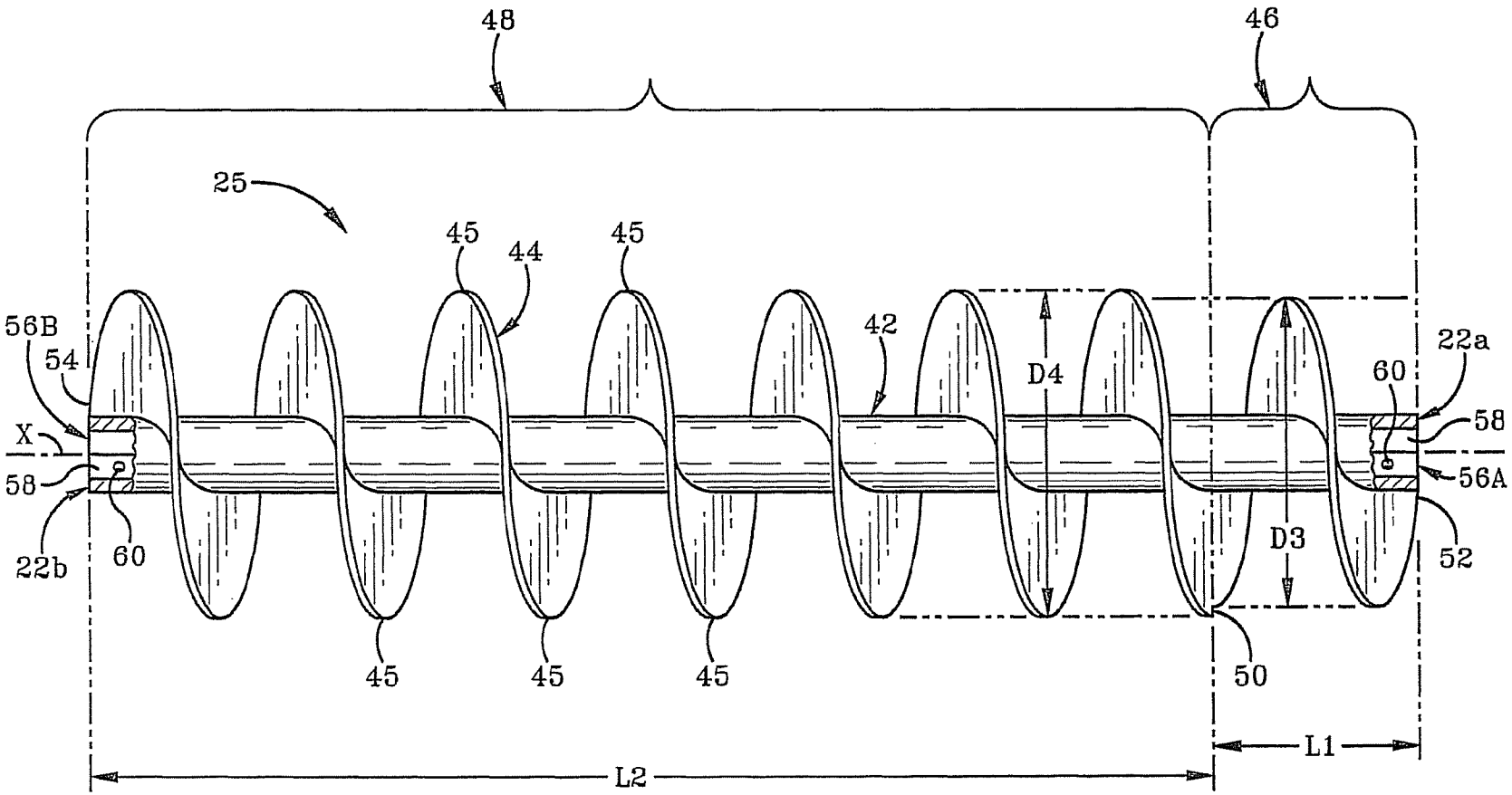
FIG. 3 is a side elevational view of the leading auger with portions cut away.

Before providing a detailed description of rock head 40, lead auger segment 25 is now described with primary reference to FIG. 3. Lead auger segment 25 is specifically configured for use with rock head 40. Auger segment 25 has a front or leading end 22*a* and a rear or trailing end 22*b* which define therebetween an axial direction of the auger and auger segment. As shown in FIG. 3, auger segment 25 during operation rotates about central axis X in order to carry excavated soil or rock rearwardly through pipe 24. Auger segment 25 has a central drive shaft 42 which is in the exemplary embodiment a cylindrical tube. Auger segment 25 further includes a helical flight 44 which is rigidly secured to and extends radially outwardly from the cylindrical outer surface of shaft 42 to a circumferentially extending helical terminal edge 45 which faces radially outwardly away from shaft 42 and axis X. Flight 44 extends from adjacent front end 22*a* to adjacent rear end 22*b* and includes a front section 46 and a rear section 48. The terminal edge 45 of front section 46 steps radially outwardly at step 50 to the terminal edge 45 of rear section 48 such that front section 46 has a diameter D3 and rear section 48 has a diameter D4 which is somewhat larger than diameter D3. Front section 46 has a front end 52 and a rear end which is represented by step 50 such that the front and rear ends of front section 46 define therebetween an axially extending length L1. Rear section 48 has a front end represented at step 50 and a rear end 54 defining therebetween an axially extending length L2 of rear section 48. In the exemplary embodiment, length L2 is far greater than length L1. Diameter D3 is constant from front end 52 to rear end or step 50, and diameter D4 is likewise constant from front end or step 50 to rear end 54. In contrast, the other augers which are connected rearwardly of lead auger 25, such as auger segment 27, have a helical flight which is constant from the front end to the rear end of the auger segment and which also has a constant diameter D4.

As illustrated in FIG. 3, auger segment 25 has front and rear connectors 56A and 56B. Front connector 56A is configured to secure to rock head 40 such that auger segment 25 extends rearwardly therefrom. Rear connector 56B is configured to be secured to the front of auger segment 27. Each auger segment 25, 27 has similar front and rear connectors such that the segments may be secured to one another in end-to-end fashion in order to intermittently lengthen the auger by adding an additional auger segment to the rear end of the auger within pipe 24. In the exemplary embodiment, front and rear connectors 56A and 56B are female hexagonal connectors, or in other words utilize a hexagonal cavity 58 or other typically non-circular cavity for receiving therein a male hexagonal connecting member or other typically non-circular connector of a mating configuration. A pin hole 60 may be formed in the side wall of the tubular shaft 42 in communication with cavity 58 for receiving therethrough a connecting pin in order to secure the respective end of shaft 42 to the connecting member, which is secured to, for example, rock head 40 or another auger segment 27. Any suitable securing mechanism may be used in order to secure the various auger segments to one another and to secure the front end of lead auger segment 25 to rock head 40 in order to provide rotational engagement therewith which is translated from rotational drive 21 through auger 22 to rock head 40.

Rock head 40 is now described with primary reference to FIGS. 4-11. Rock head 40 has front and back ends 62 and 64 defining therebetween an axial direction which is the same as the drilling or boring direction during operation. The cutter bit or rock head 40 includes three primary sections, namely a rigid base section or base 66, a rigid drive section 68 which is rotatable a limited amount about axis X relative to base 66, and a set of three movable cutter sections 70A-C each of which are movably mounted on base 66 to move radially inwardly and outwardly between a collapsed position in which rock head may be moved through bore 32 of pipe 24 from one end to the other and an expanded position in which the movable cutter sections 70 extend radially outwardly too far to fit within bore 32 so that rock head cannot be moved from one end of pipe 24 to the other through bore 32. In the exemplary embodiment, each cutter section 70 moves radially inwardly and outwardly in a non-pivoting fashion and more particularly along a line which is a radius of axis X. Each cutter section 70 slides radially outwardly in this linear fashion in response to rotation of drive section 68 relative to base 66 about axis X via respective cam surfaces, as discussed further below. In addition, cutter sections of 70 slide radially inwardly in response to opposite rotation of drive section 68 about axis X relative to base 66 via respective cam surfaces and/or spring bias, as discussed further below. Base 66 and cutter sections 70, along with other cutter sections described further below, are part of a driven section of the cutter bit or rock head 40 which is rotationally driven by drive section 68, as will be discussed more fully below.

Base 66 includes an anti-drift support ring or bearing ring 72 having a front end 74, a back end 76, a cylindrical outer surface 78 having an outer diameter D5, and a cylindrical inner surface 80 having an inner diameter D6 which is less than diameter D5 by twice the thickness of the cylindrical side wall forming ring 72. Front and rear ends 74 and 76 define therebetween a length L3 of bearing ring 72 which is typically about the same as length L1 of front flight segment 46. Diameter D5 is the same as or substantially the same as diameter D4 of rear flight segment 48 as well as the diameter of the flights of the trailing augers 27. In the exemplary embodiment, diameters D4 and D5 are about ½ inch less than diameter D1 of the bore 32 of pipe 24. Typically, the difference between diameter D1 and diameter D4 or D5 is no more than about 1 inch less although this may vary somewhat. Diameter D6 is thus the diameter of cylindrical bore 82 defined by cylindrical inner surface 80. Diameter D6 is somewhat larger than diameter D3 of front helical flight segment 46 of auger 25 whereby front segment 46 may be inserted within bore 82 when the front end 22*a* of 25 is secured to drive section 68, as discussed further below, such that the entire length of terminal edge 45 of front segment 46 faces and is adjacent inner surface 80. In the exemplary embodiment, diameter D3 is about ½ inch less than diameter D6. Typically, the difference between diameter D3 and diameter D6 is no more than about 1 inch although this may vary somewhat. Bearing ring 72 is formed integrally with three front flanges 84 which are secured to and extend forward from front end 74 of ring 72 and which are circumferentially evenly spaced from one another such that the centers of each adjacent pair of flanges 84 defines therebetween an angle of about 120 degrees about axis X. Each flange 84 extends forward from its connection at its rear end with front end 74 of ring 72 to a front end 86.

Base 66 further includes a substantially flat base plate which is arranged vertically along a plane perpendicular to axis X. Base plate 88 has a flat forward facing front surface 89 and a parallel flat rearward facing back surface 91 each of which is vertical and lies in a respective plane perpendicular to axis X. Front and rear surfaces 89 and 91 define therebetween a thickness or width W1 (FIG. 4) of base plate 88 extending in the axial direction. Base plate 88 includes an annular central section 90 having a circular inner bearing surface 92 (FIGS. 7, 11) defining a circular central through hole 94 extending from front surface 89 to back surface 91. Base plate 88 further includes a set of three first radial arms 96 which are rigidly secured to central section 90 and extend radially outwardly therefrom, and which are circumferentially evenly spaced from one another such that the centers of each adjacent pair of arms defines therebetween an angle of about 120 degrees. Base plate 88 further includes another set of three second radial arms 98 which are likewise rigidly secured to and extend outwardly from central section 90, and which are also circumferentially evenly spaced from one another such that the centers of each adjacent pair of arms 98 defines therebetween an angle of about 120 degrees. Arms 96 and 98 together are likewise substantially evenly spaced from one another circumferentially such that the center of each first arm 96 and the center of each adjacent second arm 98 define therebetween an angle of about 60 degrees. In the exemplary embodiment, first arms 96 are solid structures which extend radially outwardly from center section 90 to respective terminal ends 100.

Like first arms 96, second arms 98 are cantilevered outwardly from central section 90 thus have a radially inner end 102 secured to section 90 such that each arm extends radially outwardly to a terminal radial outer end 104. Each arm 98 has a pair of opposed radially extending parallel sides 106 extending from inner end 102 to outer end 104. A radially elongated slot or key way 108 is formed in each arm 98 extending from front surface 89 to back surface 91 such that each arm 98 includes an inner segment 110, an outer segment 112, and a pair of opposed side segments 114 extending therebetween such that the four segments circumscribe and define key way 108. Inner segment 110 has a radially outwardly facing surface 116 which faces a radially inwardly facing surface 118 of outer segment 112 whereby inner and outer surfaces 116 and 118 form opposed ends of key way 108. The side segments 114 of each arm 98 have radially elongated parallel surfaces 120 which face one another and extend from surface 116 to surface 118 perpendicular thereto and parallel to sides 106. Surfaces 116 and 118 define therebetween a radially extending length L4 (FIG. 7) of key way 108. Opposed surfaces 120 define therebetween a width W2 of key way 108 which in the exemplary embodiment is substantially less than length L4. A pair of through holes 122 are formed in outer segment 112 from outer end 104 to surface 118 and receive therein cylindrical spring mounts 124 for mounting thereon respective springs 126 such that springs 126 extend radially inwardly from spring mounts 124 respectively. A circumferentially extending hole 128 is formed in outer segment 112 extending from one side 106 to the other side 106 and through spring mounts 124 such that a bolt 130 is inserted therethrough and threadedly engages a threaded section of hole 128 in order to secure spring mounts 124 to outer segment 112 within holes 122.

Base 66 further includes three torque transfer members 132 each of which is rigidly secured to and extends rearwardly from rear surface 91 of base plate 88. Each transfer member 132 is in the form of a radially elongated arm which is parallel to and adjacent one side of the respective arm 96. Each transfer member 132 has an inner end 134 adjacent central section 90 which serves as a contact surface or torque transfer surface as discussed further below.

Figure 9:
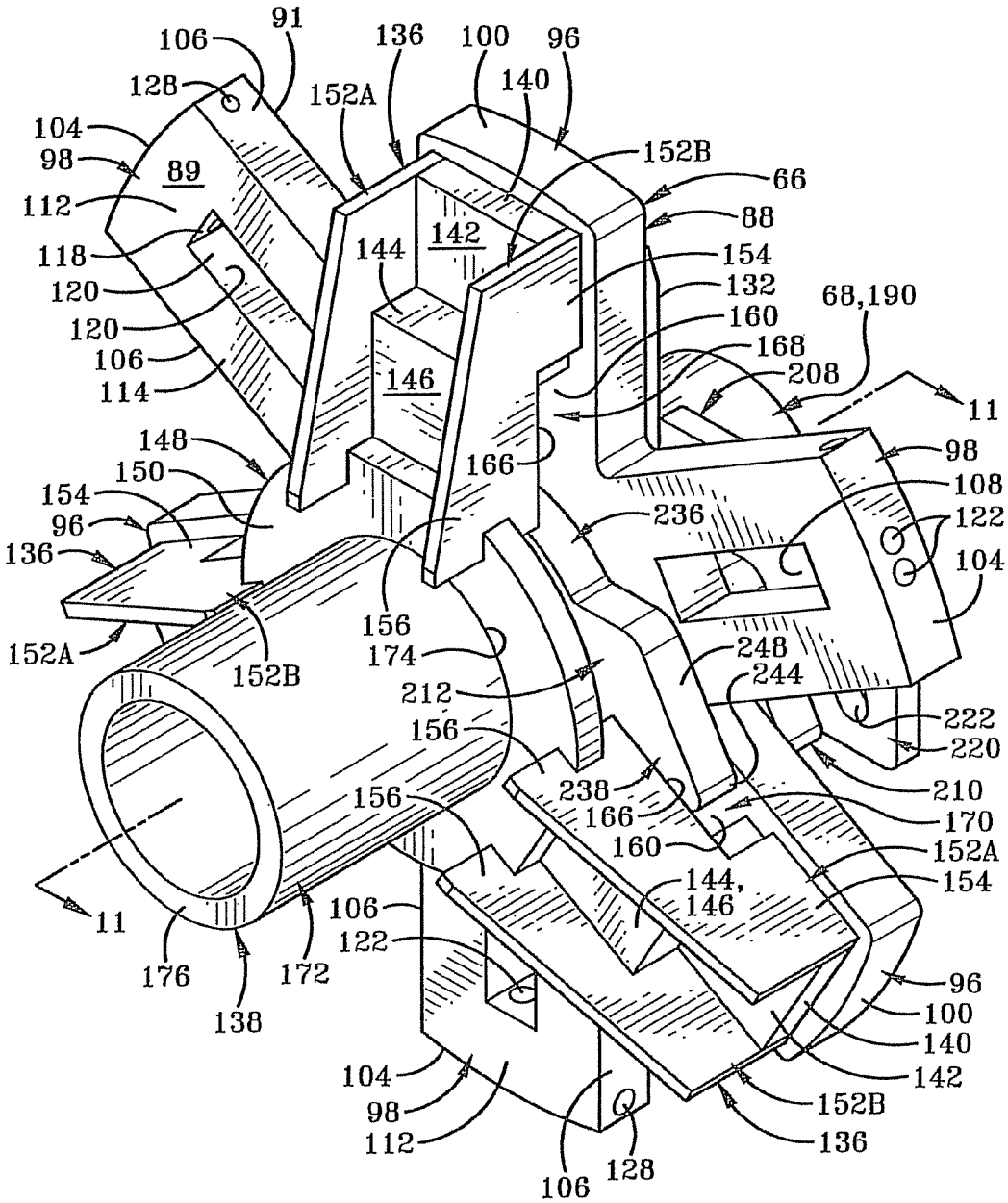
FIG. 9 is a perspective view from the front and side showing the drive section and the base section with the rock cutters, movable cutter mounts and bearing ring removed.
Figure 10:
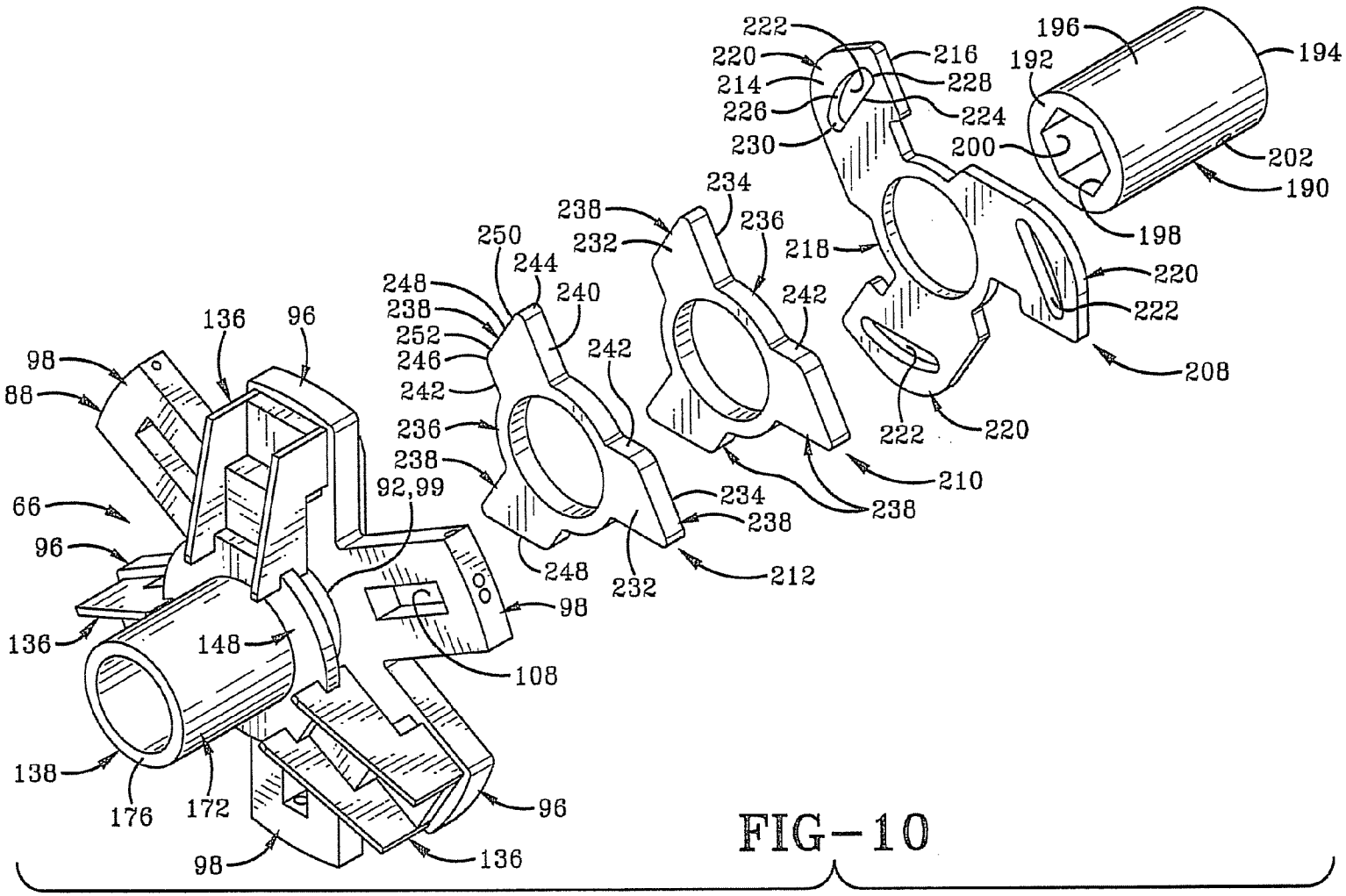
FIG. 10 is an exploded perspective of the drive section and base section of FIG. 9.
Figure 11:
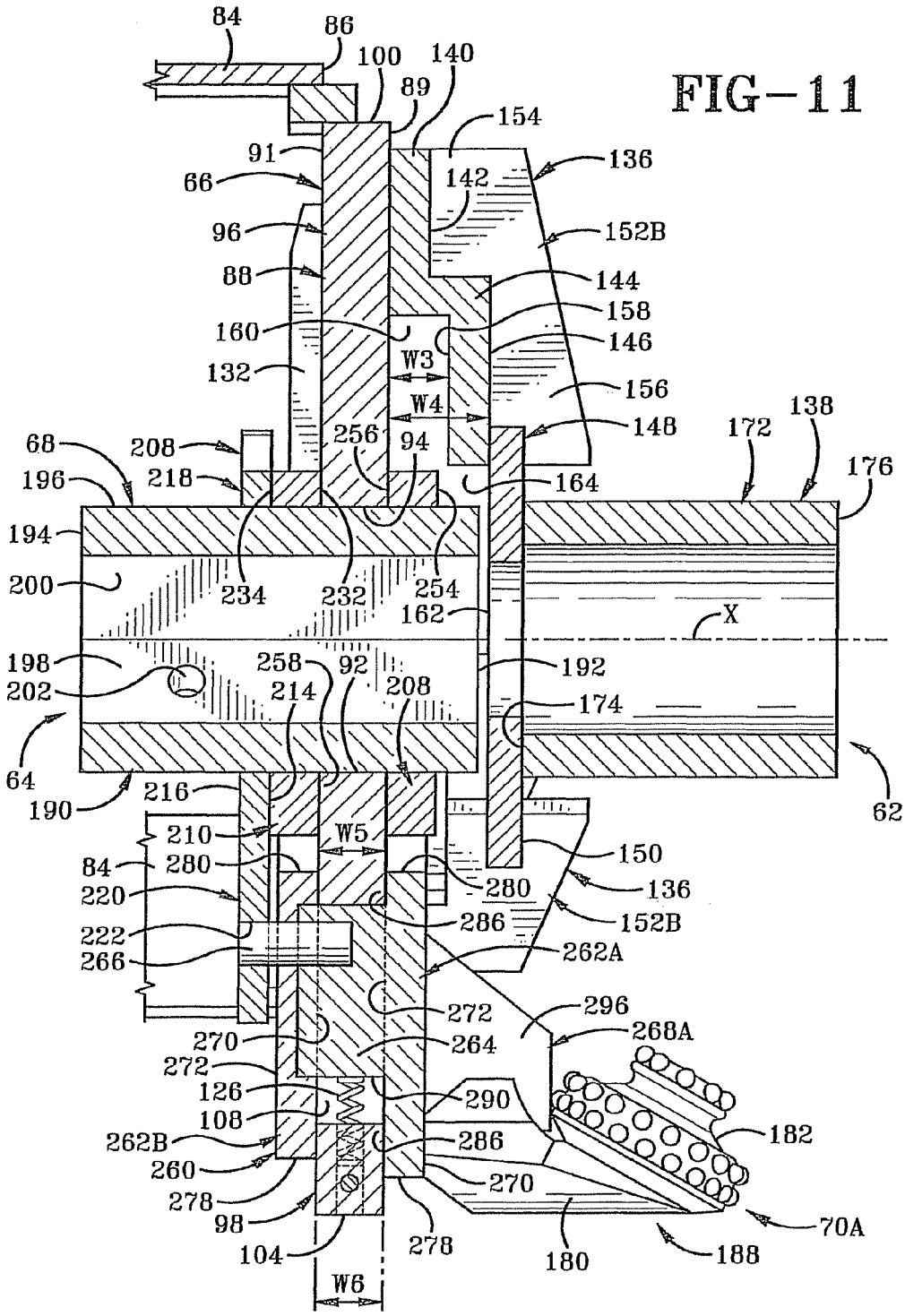
FIG. 11 is a sectional view taken on line 11-11 of FIG. 9 showing one of the cutters and two flanges of the bearing ring.

With primary reference to FIGS. 9-11, base 66 further includes three fixed intermediate cutter mounts 136 and a fixed central pilot cutter mount 138 forward of cutter mounts 136. Cutter mounts 136 and 138 are described as fixed inasmuch as they are fixed with regard to base plate 88 and the rest of base 66. Each cutter mount 136 includes a generally flat square plate which serves as an outer step 140 which has a rear surface which is rigidly secured to the front surface 89 of a respective first arm 96 and extends forward to a flat forward facing front surface 142 which is vertical and lies in a plane perpendicular to axis X forward of front surface 89. Cutter mount 136 further includes a second or intermediate step 144 which is rigidly secured adjacent its radial outer end and along its rear surface to front surface 142 of step 140 adjacent its radial inner end. Step 144 thus steps forward to a flat forward facing front surface 146 which is vertical and lies in a plane perpendicular axis X forward of front surface 142. A generally circular annular plate serves as an inner step 148 which is secured along its outer perimeter to front surface 146 of step 144 adjacent its radial inner end. Step 148 thus steps forward from step 144 to a flat annular front surface 150 which is vertical and lies in a plane perpendicular to axis X whereby front surface 150 is parallel to surfaces 146, 142, 89 and 91. Each cutter mount 136 further includes a pair of opposed flat side plates 152A and 152B which are rigidly secured to the opposed sides of step 140 and step 144. Each side plate has a generally L-shaped configuration made up of a shorter leg 154 which is rigidly secured to and extends forward from front surface 89 of arm 96 and forward of front surface 142, and a longer leg 156 which is rigidly secured to the forward end of shorter leg 154 and extends radially inwardly therefrom to a rigid connection with annular step 148 along its outer perimeter. Side plates 152A and 152B are parallel to one another and perpendicular to surfaces 89, 91, 142, 146 and 150. Step 144 has a flat rearward facing rear surface 158 which is substantially coplanar with front surface 142 of outer step 140 and is spaced forward of front surface 89 whereby rear surface 158 and front surface 89 of each respective first arm 96 define therebetween a narrower section 160 of a cam-receiving space having an axially extending width W3 (FIG. 11) defined between surfaces 89 and 158. Annular step 148 has a flat rearward facing rear surface 162 which is substantially coplanar with front surface 146 of step 144 so that rear surface 162 and front surface 89 of a respective arm 96 define therebetween a wider section 164 of the cam-receiving space which communicates with and extends radially inward from narrower section 160. Rear surface 162 and front surface 89 define therebetween an axial width W4 (FIG. 11) of wider section 164 which is thus greater than width W3.

Each longer leg 156 has a rear surface 166 which is spaced forward of front surface 89 such that surfaces 89 and 166 of the longer leg 156 of side plate 152B define therebetween a first side entrance opening 168 of the cam-receiving space through which a given portion of drive section 68 may enter the cam-receiving space during rotation of drive section 68 relative to base 66 in a clockwise direction about axis X as viewed from the rear of rock head 40. Similarly, the rear surface 66 of the longer leg 156 of a given side plate 152A is spaced forward of front surface 89 of a given arm 96 such that surfaces 89 and 166 define therebetween a second side entrance opening 170 of the cam-receiving space such that a portion of drive section 68 may enter the cam-receiving space during rotation of drive section relative to the base 66 in the opposite direction, namely, clockwise as viewed from the rear.

Central pilot cutter mount 138 comprises a cylindrical tubular shaft 172 having a rear end 174 which is rigidly secured to the front surface 150 of step 148 and extends forward to a front end 176. Shaft 172 is thus arranged centrally such that the intermediate cutter mounts 136 are spaced radially outwardly therefrom. Annular plate or step 148 thus extends radially outwardly from rear end 174 of shaft 172. Intermediate cutter mounts 136 serve as radial arms which extend radially outwardly from adjacent the outer perimeter of step 148 and then rearwardly to their respective connections with the front surface 89 of arms 96 such that the radially inward portion of the cutter mounts 136 are spaced forward of the radially inward portion of arms 96 and the radially outward portion of arms 136 extend rearwardly to mount to the radially outward portion of arms 96.

Three rock cutter assemblies 178 (FIGS. 4, 8) are secured to the front end 176 of shaft 172 and extend forward therefrom. Each cutter assembly 178 has a rigid base 180 which is rigidly secured to the front end 176 and extends forward therefrom, and a rock cutter 182 which is rotatably mounted on base 180 about a respective axis Y which is in the exemplary embodiment transverse to axis X although not perpendicular to axis X. In the exemplary embodiment, each rock cutter 182 is in the form of a roller cone although other rock cutters known in the art may be used. For example, carbide-tipped cutting tools or teeth may be used in place of the roller cones wherein the tool or tooth is securely held within a mounting sleeve such that the tooth rotates within the sleeve. Carbide discs may also serve as rock cutters and are typically rotatably mounted on a mounting structure as well. The rock cutters 182 of the three assemblies 178 are circumferentially evenly spaced about axis X.

On each fixed intermediate cutter mount 136 are mounted a pair of cutter assemblies (FIGS. 4, 8), which in the exemplary embodiment are arranged as an inner rock cutter assembly 184 and an outer rock cutter assembly 186 which is adjacent and spaced radially outwardly from inner assembly 184. Each assembly 184 and 186 includes a base 180 and a rock cutter 182 shown in the form of a roller cone although other rock cutters may be used. The base 180 of inner assembly 184 is rigidly secured to front surface 146 of second step 144, the outer perimeter of annular step 150 and the inner surfaces of side plates 152A and 152B of the respective cutter mount 136, and extends forward therefrom with rock cutter 182 rotatably secured adjacent its forward terminal end in the same manner as described with cutter assembly 178. Similarly, the base 180 of outer assembly 186 is rigidly secured to front surface 142 of outer step 140, the outer end of second step 144 and plates 152A and 152B, and extends forward therefrom with a respective rock cutter 182 rotatably mounted adjacent its forward terminal end. Thus, each rock cutter 182 of assembly 184 is spaced substantially rearwardly of the rock cutters 182 of the pilot assemblies 178, and in the exemplary embodiment are adjacent and rearward of the rear end of the base 180 of the pilot assemblies 178 and front end 176 of shaft 172. The rock cutter 182 of each outer assembly 186 is positioned generally adjacent, radially outwardly of and somewhat rearwardly of the cutter 182 of the corresponding inner assembly 184. Although the cutters 182 of these various assemblies 178, 184 and 186 are rotatable as previously discussed, the respective bases 180 of these assemblies is fixed relative to base 66 on which they are mounted. In contrast, there are also three movable cutter assemblies 188 of movable sections 70A-C each including a base 180 and a rotatable rock cutter 182 which are mounted such that the base 180 and rock cutter 182 are movable relative to the base section or base 66 and relative to drive section 68, as will be discussed in greater detail further below.

Drive section 68 is now described with primary reference to FIGS. 4-11. Drive section 68 includes a torque drive connector 190 which is a substantially a cylindrical tubular member having front and back ends 192 and 194, a cylindrical outer surface 196 extending from front end 192 to back end 194, and a hexagonal inner surface 198 defining therewithin a hexagonal interior chamber 200. Inner surface 198 and chamber 200 may be of a different configuration, preferably non-circular. A pair of lock pin holes 202 are formed on opposite sides of the cylindrical side wall of connector 190 extending from outer surface 196 to inner surface 198. A hexagonal male connector 204 (FIG. 14) having a hexagonal cross section of mating configuration with hexagonal inner surface 198 is inserted into interior chamber 200, which serves as a female connector. Male connector 204 includes a hole aligned with holes 202 for receiving therethrough a lock pin 206 (FIG. 14) for securing connector 204 to drive connector 190. Front end 192 of drive connector 190 faces and is closely adjacent rear surface 162 of annular step 148 such that there is typically a sliding engagement between surfaces 162 and 192 during rotation of drive section 68 relative to base 66 about axis X.

Drive section 68 further includes a first or rear cam plate 208, a second or middle cam plate 210 and a third or front cam plate 212, one or more of which serves as a torque translation member as discussed further below. First cam plate 208 has flat parallel front and back surfaces 214 and 216 which are vertical and perpendicular to axis X. First plate 208 has an annular central section 218 with three cam arms 220 rigidly secured to and extending radially outwardly from section 218 and circumferentially spaced from one another. Section 218 defines a circular central hole which receives drive connector 190 such that central section 218 is rigidly secured to the cylindrical outer surface 196 by welding or the like. A circumferentially elongated slot 222 is formed in each cam arm 220 extending from front surface 214 to back surface 216. In the exemplary embodiment, slot 222 is bounded by or defined by a circumferentially extending straight surface 224 which faces radially outwardly, an arcuate concave cam surface 226 which faces radially inwardly and extends circumferentially, and a pair of end surfaces 228 and 230 which face one another and extend radially between surfaces 224 and 226.

The second or middle cam plate 210 has front and back surfaces 232 and 234 which are parallel, vertical and lie in a plane perpendicular to axis X. Back surface 234 is closely adjacent and typically in contact with front surface 214 of rear plate 208. Plates 208 and 210 may be rigidly secured to one another by welding or another fastening mechanism. Second plate 210 has a circular annular central section 236 and three cam arms 238 which are rigidly secured to and extend radially outwardly from section 236 in a cantilevered fashion. Arms 238 in the exemplary embodiment also serve as torque transfer members or arms as discussed below. Each arm 238 has parallel sides which face away from one another, namely a longer side 240 and a shorter side 242 which is shorter than side 240 and which also serves as a torque transfer contact surface. Longer side 240 extends outwardly to a first rounded corner 244, and shorter side 242 extends radially outwardly to a second rounded corner 246 wherein corners 244 and 246 transition into a straight circumferentially extending cam surface 248 which faces radially outwardly and angles radially inwardly from a first end 250 adjacent first corner 244 to a second end 252 adjacent second corner 246. First end 250 of cam surface 248 is thus adjacent the outer end of longer side 240 while second end 252 is adjacent the outer end of shorter side 242. First rounded corner 244 and first end 250 are further away from axis X than are second corner 246 and second end 252. Longer side 240 and cam surface 248 define therebetween an acute angle A (FIG. 6) while shorter side 242 and cam surface 248 define therebetween an obtuse angle B. Cam surface 248 extends transverse to a radius R1 of axis X at an angle which is not perpendicular to radius R1. In the exemplary embodiment, radius R1 is parallel to and midway between sides 240 and 242. Radius R1 also intersects the midpoint of cam surface 248 midway between first and second ends 250 and 252. More particularly, surface 248 and radius R1 define therebetween an angle C which in the exemplary embodiment is about the same as angle A and is on the order of about 60 degrees, and typically falls within a range of about 45, 50 or 55 degrees to 65, 70 or 75 degrees.

Third cam plate 212 has flat parallel vertical front and back surfaces 254 and 256 which are perpendicular to axis X. Back surface 256 is spaced forward of front surface 232 of middle plate 210 such that surfaces 232 and 256 define therebetween an annular space or channel 258 (FIG. 11) which extends all the way around or circumscribes cylindrical surface 196 and extends radially outwardly therefrom. Outer surface 196 thus forms the radial inner boundary of space 258, which is open along the outer perimeters of plates 210 and 212. Plate 212 is substantially identical to plate 210 and is numbered in the same manner. Plate 212 is also rigidly secured to the outer perimeter 196 of drive connector 190 with the respective cam arms 238 of plates 210 and 212 aligned with one another.

Front surface 232 of plate 210 and rear surface 256 of plate 212 define therebetween an axial width W5 (FIG. 11) of space or channel 258 which is a little larger than width W1 (FIG. 4) of base plate 88, whereby base plate 88 is positioned between plates 210 and 212 with front surface 89 thereof facing and adjacent rear surface 256 of plate 212 and rear surface 91 facing and adjacent front surface 232 of plate 210. Front surface 89 is sufficiently close to rear surface 256 to provide a sliding engagement therebetween during rotation of drive section 68 relative to base 66 about axis X. Likewise, rear surface 91 is sufficiently close to front surface 232 of plate 210 to provide a sliding engagement therebetween during said relative rotation of drive section 68. In addition, a sliding engagement occurs between cylindrical inner surface 92 of base plate 88 and the portion of cylindrical outer surface 196 of connector 190 which bounds channel 258 during the rotation of drive section 68. The sliding engagement between front surface 89 and rear surface 256 includes a sliding engagement between rear surface 256 of annular central section of 236 and front surface 89 of annular central section 90 as well as a sliding engagement between rear surface 256 of each cam arm 238 and the front surface 89 of one of arms 96 and one of arms 98 adjacent to said arm 96. Due to the limited rotation of drive section 68 relative to base 66, each cam arm 238 will only slidably engage one of arms 96 and one of arms 98 in the exemplary embodiment. The sliding engagement between front surface 232 of plate 210 and back surface 91 of base plate 88 includes the sliding engagement of surface 232 of annular central section 236 and rear surface 91 of annular central section 90, as well as a sliding engagement between front surface 232 of each cam arm 238 and rear surface 91 of annular central section 90. This sliding engagement also includes a sliding engagement between front surface 232 of each cam arm 238 and the rear surface 91 of one of radial arms 96 and one of radial arms 98. As previously noted, due to the limited degree of rotation of drive section 68, each cam arm 238 only slidably engages one of arms 96 and one of arms 98 in the exemplary embodiment.

Figure 6:
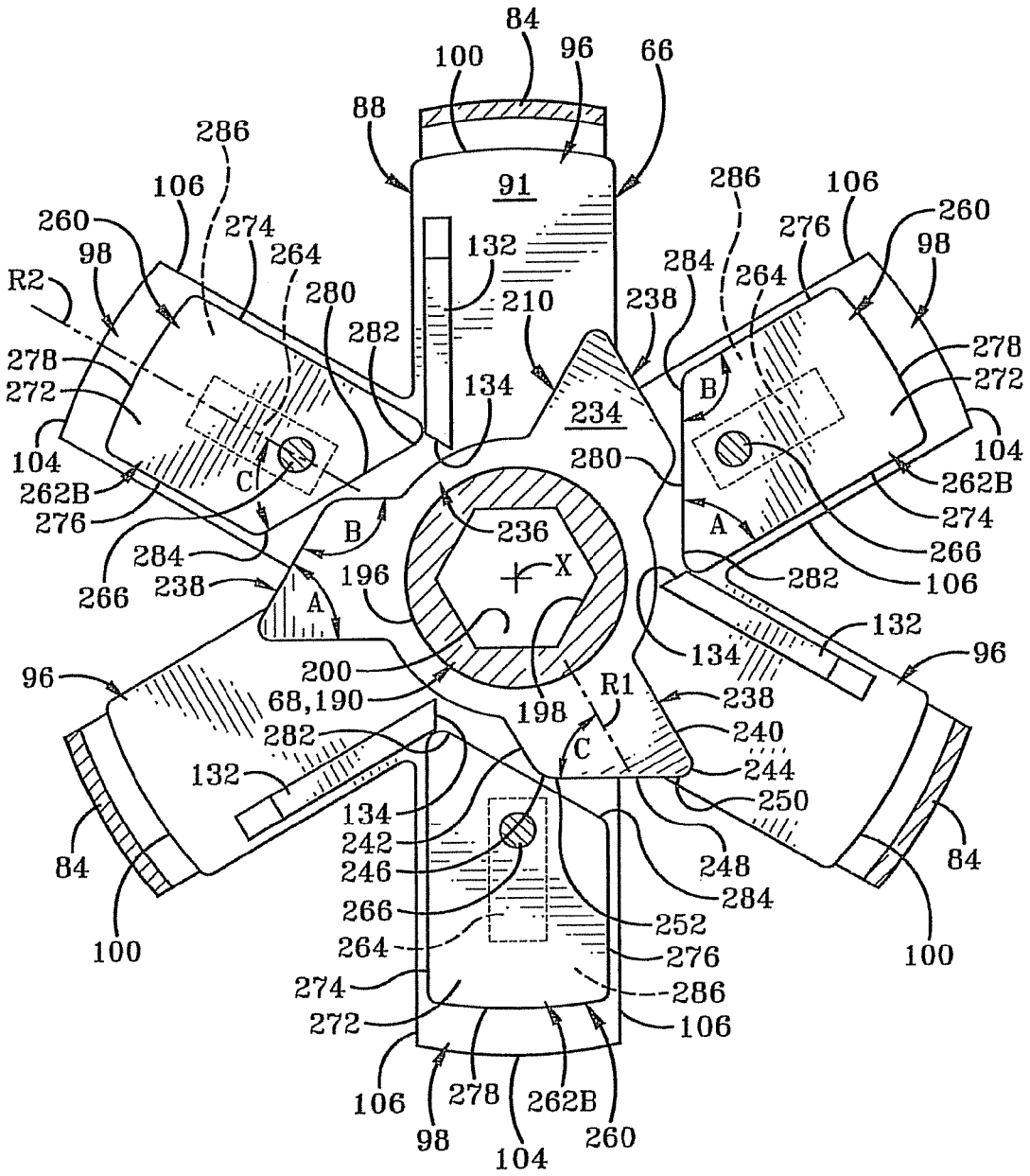
FIG. 6 is a sectional view taken on line 6-6 of FIG. 4.
Figure 7:
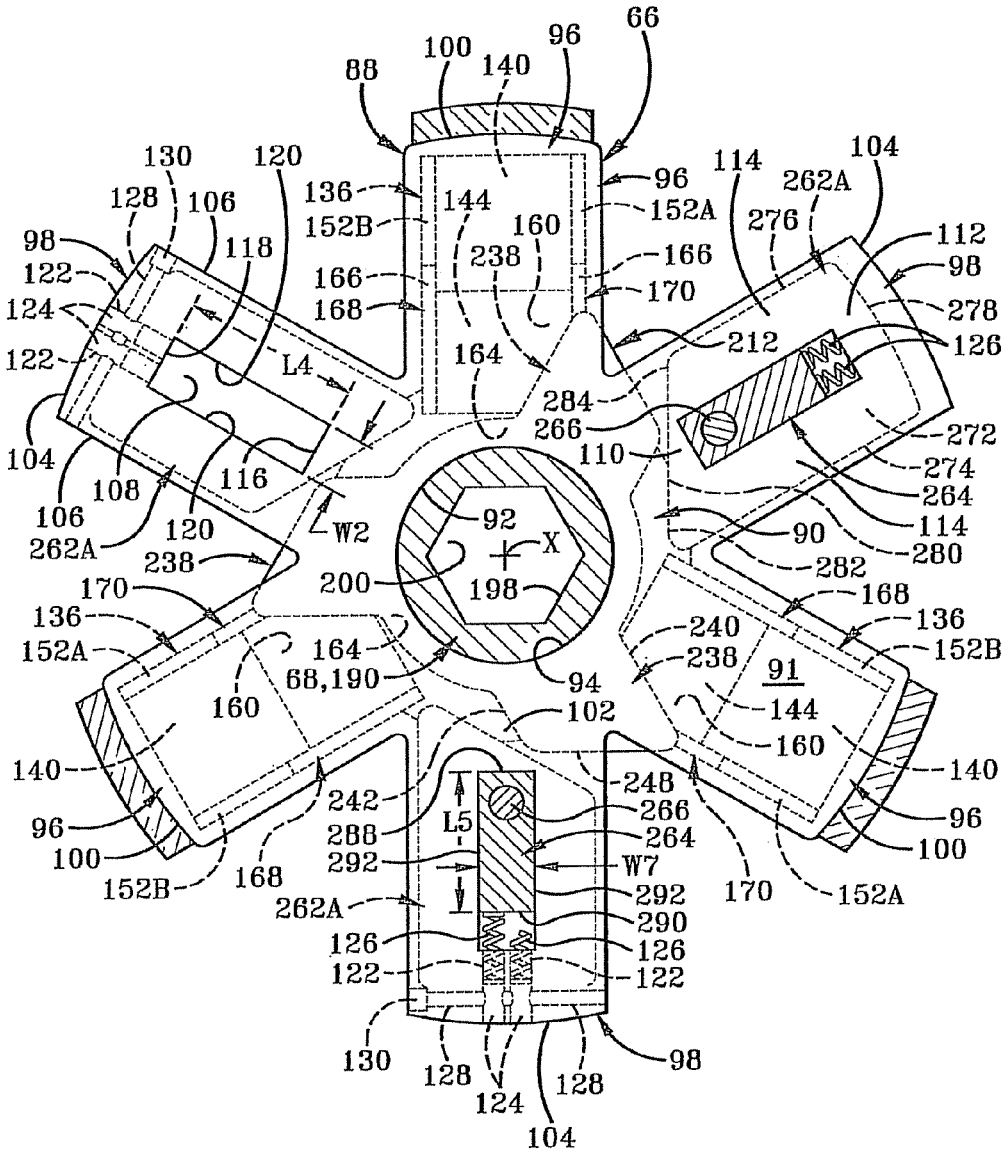
FIG. 7 is a sectional view taken on line 7-7 of FIG. 4.

With primary reference to FIGS. 6 and 7, the relative position of plates 210 and 212 in the collapsed position is now described. As viewed from the rear or front parallel to axis X, each cam arm 238 in the collapsed position overlaps a portion of one of arms 96 and a portion of one of arms 98 of base plate 88. In the exemplary embodiment, the longer side 240, rounded corner 244, first end 250 and a portion of cam surface 248 adjacent first end 250 overlaps one of arms 96 adjacent one of its radially extending sides. In the collapsed position, the shorter side 242, corner 246, second end 252 and the portion of cam surface 248 adjacent second end 252 overlap one of arms 98 adjacent one of its sides 106. Cam arms 238 of plate 212 overlap arms 96 and 98 in the same manner as do cam arms 238 of plate 210 except forward of plate 88. In addition, a portion of each cam arm 238 of plate 212 in the collapsed position is disposed within the narrower portion 160 of the cam-receiving space defined between one of arms 96 and the corresponding radial arm or cutter mount 136. More particularly, all or part of longer side 240 of a given arm 238 of plate 212 is disposed within space 160. In addition, corner 244, first end 250 and a portion of cam surface 248 may also be within the cam-receiving space in the collapsed position.

Movable cutter sections 70A-C are now described with primary reference to FIGS. 4-8 and 11. Each of cutter sections 70 includes one of cutter assemblies 188. Each section 70 includes a movable cutter mount 260 on which the base 180 of each assembly 188 is rigidly secured. Each cutter mount 260 is slidably mounted on a respective one of radial arms 98 of base plate 88 to slide non-pivotably and in a linear fashion radially inwardly and outwardly as previously noted with the initial discussion of movable cutter sections 70. Each cutter mount 260 includes front and rear cam followers or plates 262A and 262B, a key 264 which extends between and is rigidly secured to plates 262A and 262B, a cam follower or post 266 rigidly secured to rear plate 262B and extending rearwardly therefrom, and a pair of side plates 268A and 268B which are rigidly secured to and extend forward from front follower or plate 262A. Each plate 262 has flat front and back surfaces 270 and 272 which are vertical and lie in respective parallel planes perpendicular to axis X.

Each plate 262 has parallel radially extending sides, namely a longer side 274 and a shorter side 276 which faces away from and is shorter than side 274. Plate 262 has a terminal radial outer end 278 extending from side 274 to 276 and an inner end or cam surface 280 which angles radially inwardly from adjacent the inner end of shorter side 276 to adjacent the inner end of longer side 274. Each circumferentially elongated cam follower surface 280 faces radially inwardly and has a first end 282 adjacent the inner end of longer side 274 and a second end circumferentially spaced from end 282 and adjacent the inner end of shorter end 276. In the exemplary embodiment, cam surface 280 and longer side 274 define therebetween angle A, which is thus the same angle as defined between cam surface 248 of cam 238 and longer side 240 thereof. Cam surface 280 and shorter side 276 define therebetween an angle B, which is likewise the same angle as defined between cam surface 248 and shorter side 242 of cam 238. Cam follower surface 280 extends transverse to a radius R2 of axis X at an angle which is not perpendicular to radius R2. In the exemplary embodiment, radius R2 is parallel to and midway between sides 274 and 276. Radius R2 also intersects the midpoint of cam follower surface 280 midway between first and second ends 282 and 284. More particularly, surface 280 and radius R2 define therebetween angle C in the exemplary embodiment, which is thus the same angle as defined between surface 248 and radius R1 as discussed above.

Back surface 272 of front plate 262A is spaced forward of front surface 270 of rear plate 262B such that said surfaces define therebetween an arm or plate-receiving space 286 having a width W6 (FIG. 11) which is substantially equal to width W5 in the exemplary embodiment. Space 286 is an annular space which circumscribes key 264 as viewed from the rear and thus extends outwardly from key 264 in all directions as viewed from the rear (FIG. 6). Rear surface 272 of front follower 262A faces and is sufficiently close to front surface 89 of the respective arm 98 which carries the given cutter mount 260 to provide a sliding engagement therebetween during radial inward and outward movement of cutter mount 260 relative to the carrying arm 98. Front follower 262A extends outwardly from key 264 in all directions as viewed from the rear beyond the surfaces which define key way 108, namely beyond surfaces 116, 118 and 120. Thus, plate 262A completely covers the front entrance opening of key way 108 whereby the rear surface 272 of plate 262A slidably engages the front surface 89 of the inner segment 110, outer segment 112 and side segments 114 of the arm 98 carrying cutter mount 260 during its radial inward and outward movement. Rear follower plate 262B likewise extends outwardly in all directions as viewed from the rear from key 264 such that front surface 270 thereof faces and slidably engages the rear surface 91 of the corresponding arm 98 along segments 110, 112 and 114. Rear plate 262B thus also completely covers the rear entrance opening of key way 108.

Key 264 is rigidly secured to the rear surface 272 of follower 262A and extends rearwardly to a rigid connection with front surface 270 of rear follower 262B. Key 264 thus extends through key way 108 from its front to its rear, or from front surface 89 to back surface 91 of the carrying arm 98. Key 264 has a radial inner end 288 and a radial outer end 290 which define therebetween a length L5 (FIG. 7) which is shorter than length L4 of key way 108 to allow for radial inward and outward movement of cutter mount 260 with key 264 within key way 108. Key 264 has opposed sides 292 which face away from one another and toward respective surfaces 120 of key way 108 and define therebetween a width W7 (FIG. 7) which is slightly less than width W2 of key way 108 whereby surfaces 292 slidably engage surfaces 120 respectively during radial inward and outward movement of cutter mount 260 while the relatively close tolerance or dimensions of width W2 and W7 substantially prevent the rotation of cutter mount 260 relative to arm 98 and all of base 66 during radial inward and outward of movement of cutter 260. The radial inner ends of springs 126 abut outer end 290 of key 264 while the radial outer ends of springs 126 abut and are mounted on spring mounts 124 such that springs 126 provide a spring bias of key 264 and cutter mounts 260 radially inward toward axis X.

Figure 8:
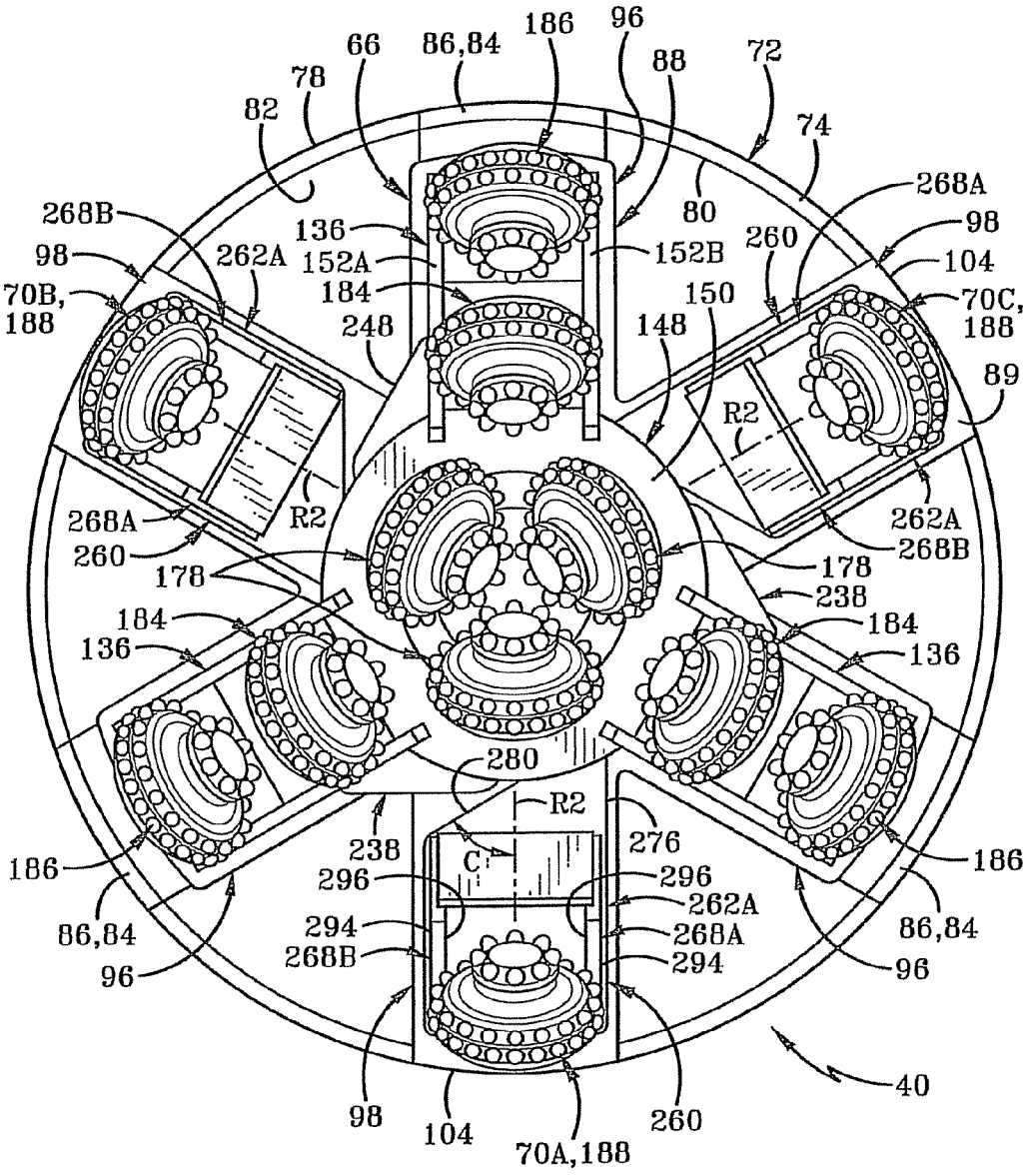
FIG. 8 is a front end elevational view of the rock head taken on line 8-8 of FIG. 4.

With primary reference to FIGS. 8 and 11, flat side plates 268A and 268B are substantially parallel to one another and extend radially outwardly. The respective pair of plates 268A and 268B of a given cutter mount 260 have flat parallel outer sides 294 which face away from one another and flat parallel inner sides 296 which face toward one another and are parallel to sides 294. The side plates and their respective sides 294 and 296 are typically substantially perpendicular to front surface 270 of plate 262A and extend forward therefrom such that plates 268A and 268B define therebetween a mounting space in which a respective base 180 of a cutter assembly 188 is secured. More particularly, said base 180 is rigidly secured to front surface 270 of plate 262A and the inner sides 296 of the side plates 268A and 268B and extend forward and radially outwardly therefrom. Front surface 270 of plate 262A is generally coplanar with the front surfaces 142 of outer steps 140 whereby the cutters 182 of assemblies 188 are at about the same position in the axial direction, such that the front ends of cutters 182 of assemblies 188 and 186 lie more or less along a common plane perpendicular to axis X and are thus rearward of the front ends of cutters 182 of assemblies 184 and assemblies 178.

Figure 12:
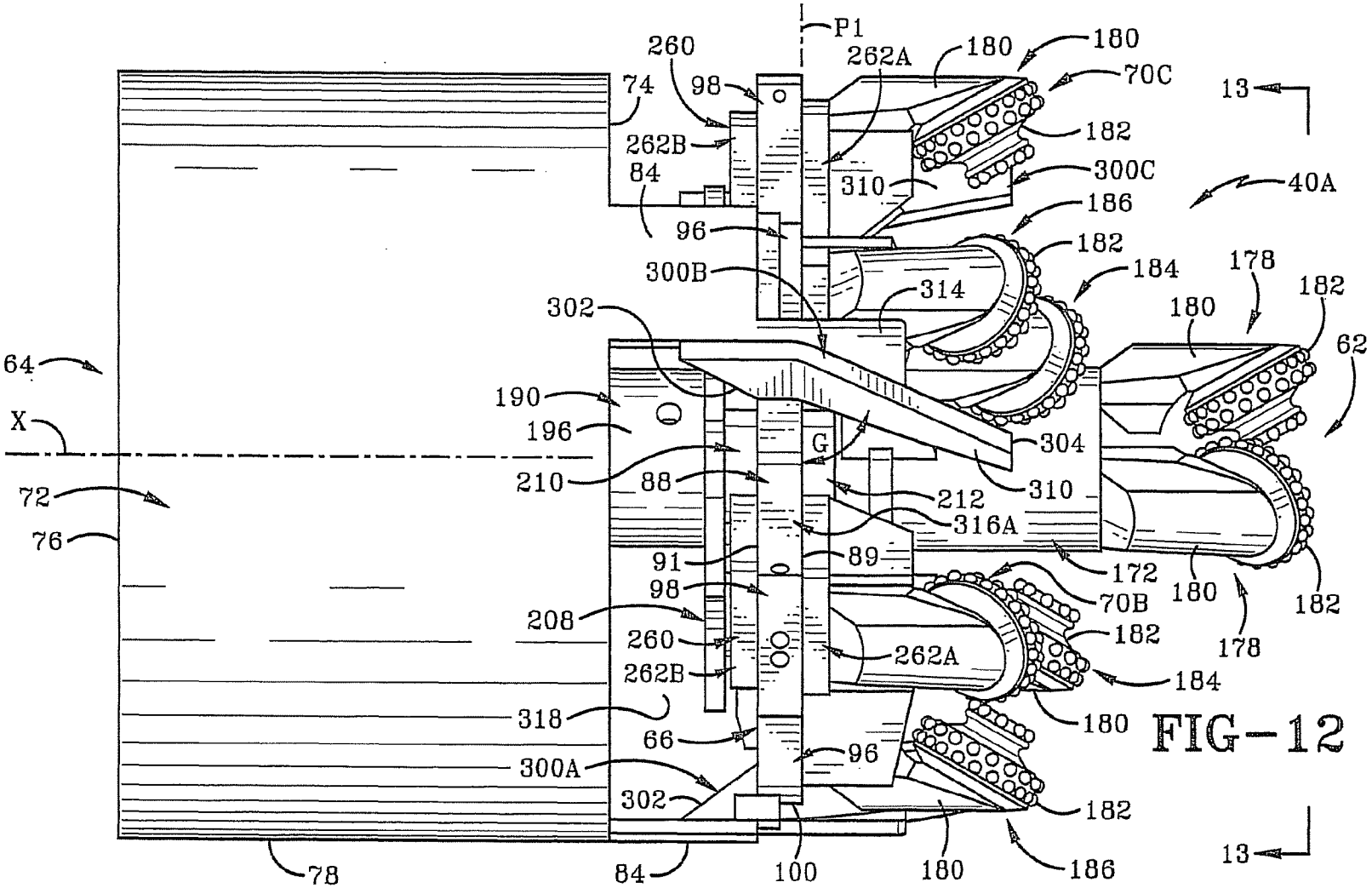
FIG. 12 is a side elevational view similar to FIG. 4 in which the rock head is modified to include angled wipers circumferentially intermediate some of the cutters and cutter mounts.
Figure 13:
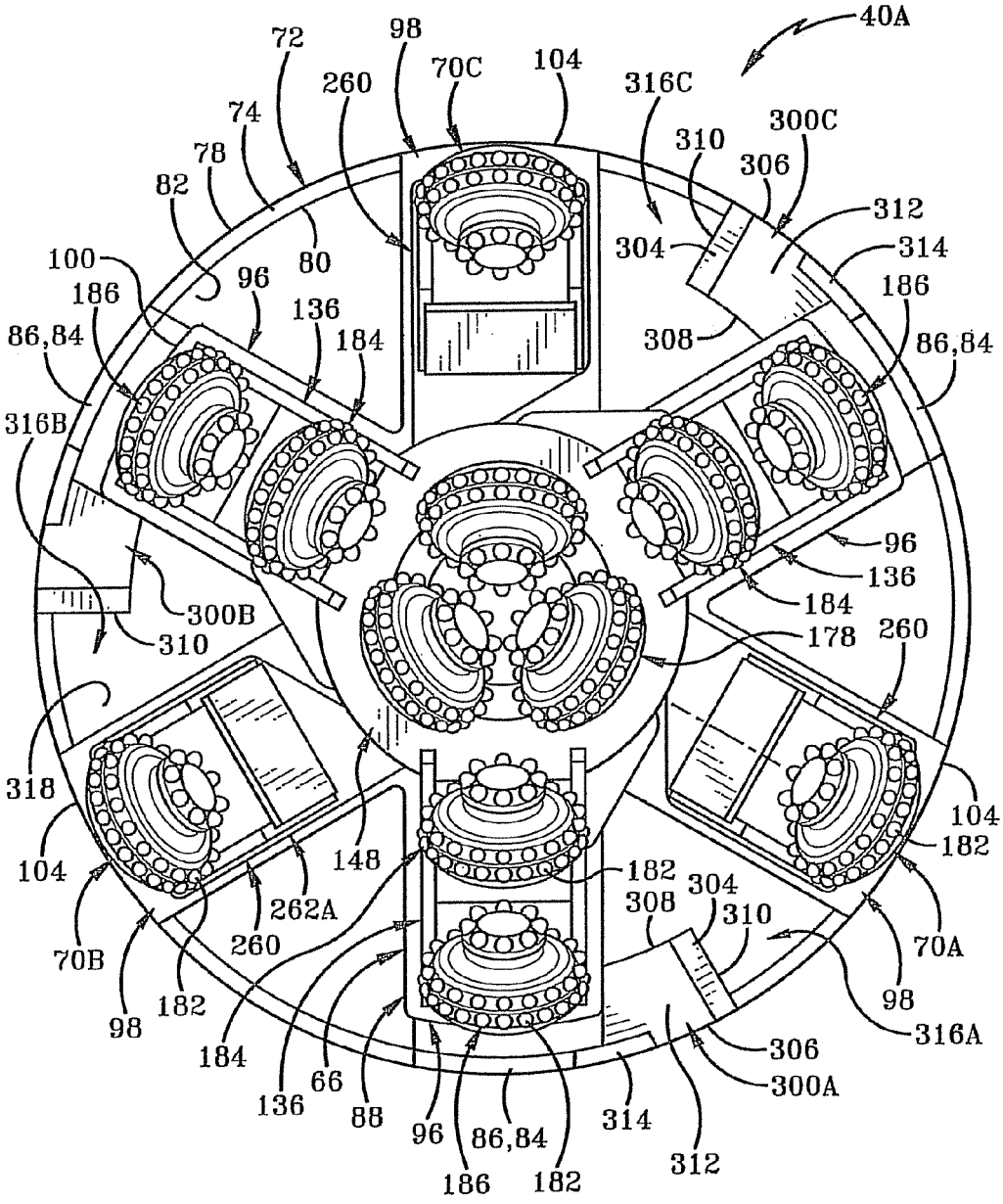
FIG. 13 is a front end elevational view similar to FIG. 8 taken on line 13-13 of FIG. 12 showing the rock head modified with the wipers.

FIGS. 12 and 13 show the rock head with a modification to include three rigid metal wipers 300A-C. The modified rock head of FIGS. 12 and 13 is thus numbered as rock head 40A. As shown in FIG. 13, each wiper 300 is disposed circumferentially between a pair of the rock cutters 182. For instance, wiper 300A is positioned between rock cutter 182 of cutter section 70A and the rock cutters 182 of cutter assemblies 184 and 186 at the bottom of FIG. 13. More particularly, wiper 300A is directly between the rock cutters 182 of assemblies 70A and the outer rock cutter assembly 186 at the bottom of FIG. 13. Wiper 300B is likewise disposed circumferentially intermediate the rock cutters and associated structure of cutter section 70B and the assemblies 184 and 186 at the upper left of FIG. 13. Likewise, wiper 300C is circumferentially intermediate the rock cutters and associated structure of cutter section 70C and the cutter assemblies 184 and 186 generally at the upper right of FIG. 13.

Each wiper 300 has a rear end 302 and is cantilevered forward to an opposed front free or terminal end 304 which faces forward. Each wiper includes a radial outer edge 306 which faces radially outwardly and a radial inner edge 308 which faces radially inwardly, with edges 306 and 308 extending from rear end 302 to front end 304. Each wiper further includes a leading face 310 and a trailing face 312, each of which extends from rear end 302 to front end 304 and from outer edge 306 to inner edge 308. Outer edge 306 lies on or adjacent the cylinder defined by outer surface 78 of bearing ring 72. In the exemplary embodiment, inner edge 308 is radially inward of the radial outer edge of cutter 182 of the adjacent outer assembly 186 and radially outward of the radial inner edge of said rock cutter 182. In the collapsed position, inner edge 308 is likewise radially inward of the radial outer edge of rock cutter 182 of the adjacent movable cutter assembly 70A and radially outward of the radial inner edge of said rock cutter 182. In the exemplary embodiment, each front end 304 is directly between the rock cutters 182 of the adjacent movable cutter assembly 70 and outer cutter assembly 186. Front end or edge 304 serves as a scraping or wiping edge which is rearward of the front edges of cutters 182 of assemblies 70 and 186 although not spaced very far rearwardly of the front edges of said cutters. In the exemplary embodiment, front edge 304 of each wiper 300 is forward of the rear edges of rock cutters 182 of assemblies 70 and 186. In the exemplary embodiment, front edge 304 is also rearward of the front ends or edges of rock cutters 182 of assemblies 184 and forward of the rear ends or edges of said cutters 182. In the exemplary embodiment, each wiper 300, like cutter assemblies 70, 184 and 186, is entirely rearward of the front end of shaft 172 as well as pilot cutter assemblies 178.

Most of each wiper 300 extends forward of front surface 89 of base plate 88 such that wipers 300A-C are respectively directly forward of wedge-shaped spaces 316A-C which are respectively defined between an adjacent pair of radial arms 96 and 98 of base plate 88. Each space 316 serves as a front entrance opening to an annular space 318 which circumscribes torque drive connector 190 and is generally radially inward of flanges 84. Annular space 318 is forward of and communicates with bore 182 of bearing ring 72. Annular space 318 also opens radially outwardly along outer surface 78 of ring 72 between each adjacent pair of flanges 84.

Each wiper 300 is positioned at an angle such that the front end 304 is disposed further to the right than is the rear end 302 as viewed from the side, and as generally shown in FIG. 12. Thus, leading face 310 faces rearwardly and circumferentially to the right toward the adjacent movable cutter assembly 70 as viewed from the side. Leading face 310 thus faces circumferentially in the driving direction of the cutter head 40 during its rotation in the clockwise direction about axis X such that leading face 310 is forced against pieces of rock which are cut by the rock cutters during operation. The angled nature of leading face 310 causes these pieces of rock to move rearwardly through entrance openings 316 into annular space 318 and bore 82 to facilitate movement of these pieces of rock to the front of the lead auger, which then carries the ground rock rearwardly through bore 82 and the underground pipe. Trailing face 312 faces forward and circumferentially to the left toward the adjacent fixed cutter assembly 186 as viewed from the side. Leading face 310 and a plane P1 perpendicular to axis X define therebetween an angle G. Angle G typically falls within the range of about 45 to 75 degrees, more typically between 50 and 70 degrees and usually is within the range of about 55 to 65 degrees. In the exemplary embodiment, angle G is about 60 degrees. Trailing face 312 is typically substantially parallel to leading face 310 and faces in the opposite direction. Each wiper 300 is rigidly secured to other structure of base 66 such as by welding to base plate 88, one of flanges 84 and/or one of the fixed intermediate cutter mounts 136. Each flange 84 may include a forward extension 314 which is typically rigidly secured to one of cutter mounts 136 as well as to the trailing face 312 of the respective wiper 300, typically by welding.

Figure 14:
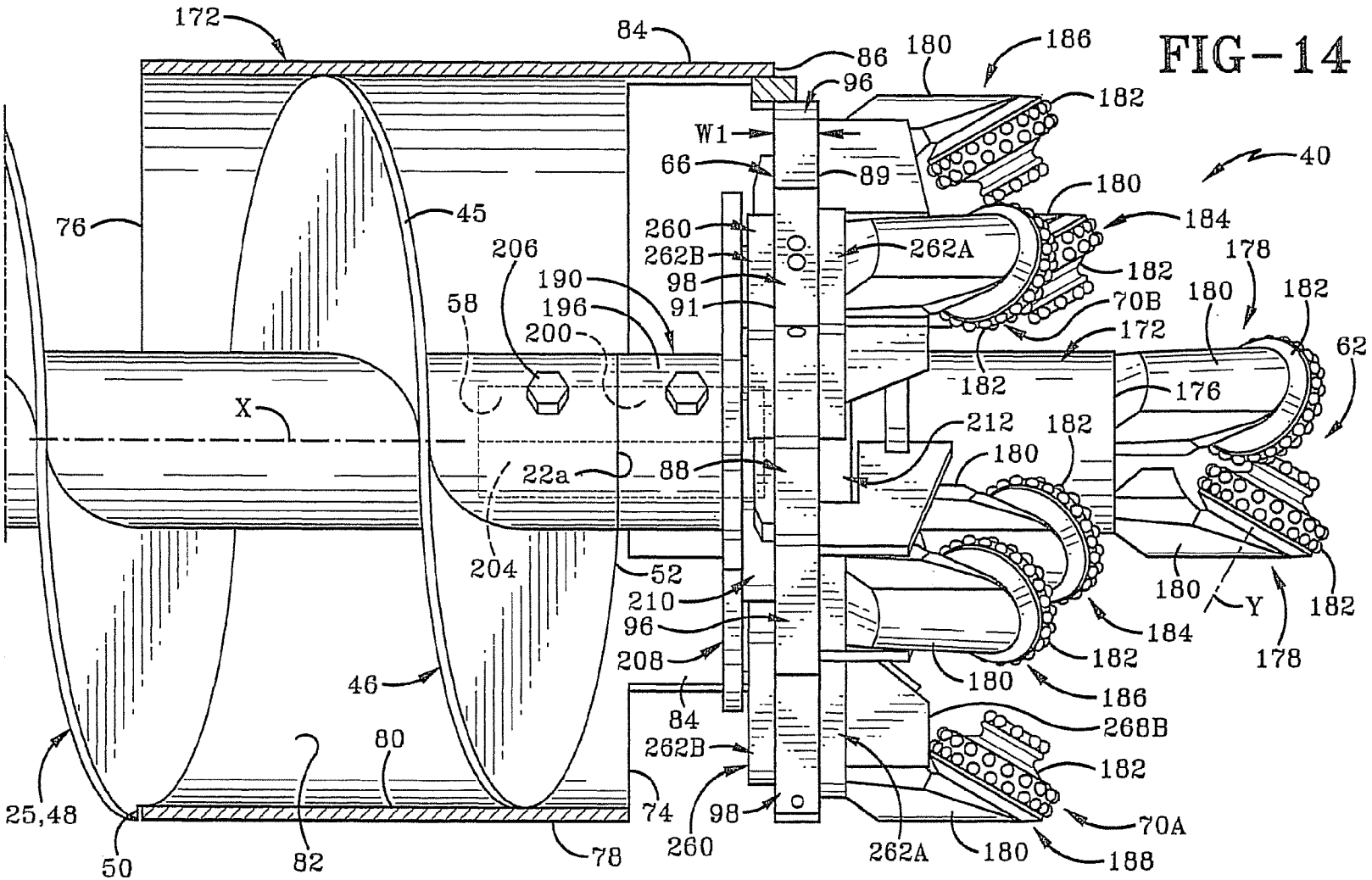
FIG. 14 is a side elevational view of the rock head connected to the front of the lead auger.

FIG. 14 shows the front end of lead auger 25 connected to torque drive connector 190 with hexagonal male connector 204 received in hexagonal cavity 58 of the front end of auger 25 and a locking pin 206 extending through holes 60 and the hole in connector 204. Auger segment 25 is thus secured at its front end to connector 190 to provide a torque drive connection therebetween and a secure connection which prevents axial movement of auger 22 relative to rock head 40 and thus allows the rearward withdrawal of auger 22 to pull rock head 40 rearwardly therewith. As shown in FIG. 14, front end 22*a* of auger segment 25 and front end 52 of front flight segment 46 are substantially aligned with front end 74 bearing ring 72 as viewed from the side. Likewise, rear end 50 of front flight segment 46 is substantially aligned with rear end 76 of bearing ring 72 as viewed from the side although end 50 is spaced slightly rearwardly of end 76. FIG. 14 also illustrates that front segment 46 is sized to fit within bore 82 with terminal edge 45 thereof facing and adjacent inner surface 80 of bearing ring 72 along the entire helical length of edge 45 of front segment 46 and substantially along the entire axial length of ring 72. Front end 50 of rear flight segment 48 is thus adjacent and rearward of rear end 76 of bearing ring 72.

Figure 15:
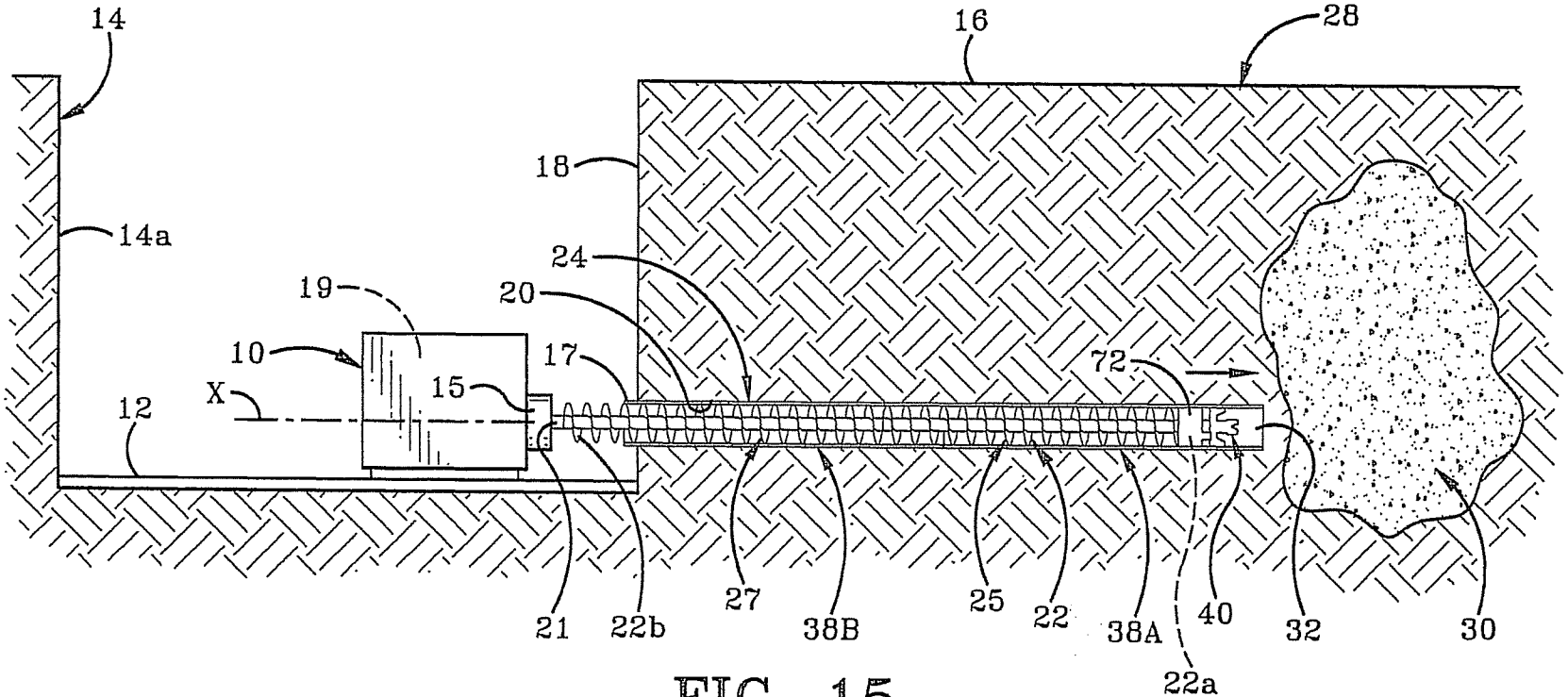
FIG. 15 is a similar to FIGS. 1 and 2 and shows the auger boring machine advancing forward in order to push the auger and rock head in its collapsed position forward through the bore of the underground pipe.
Figure 16:
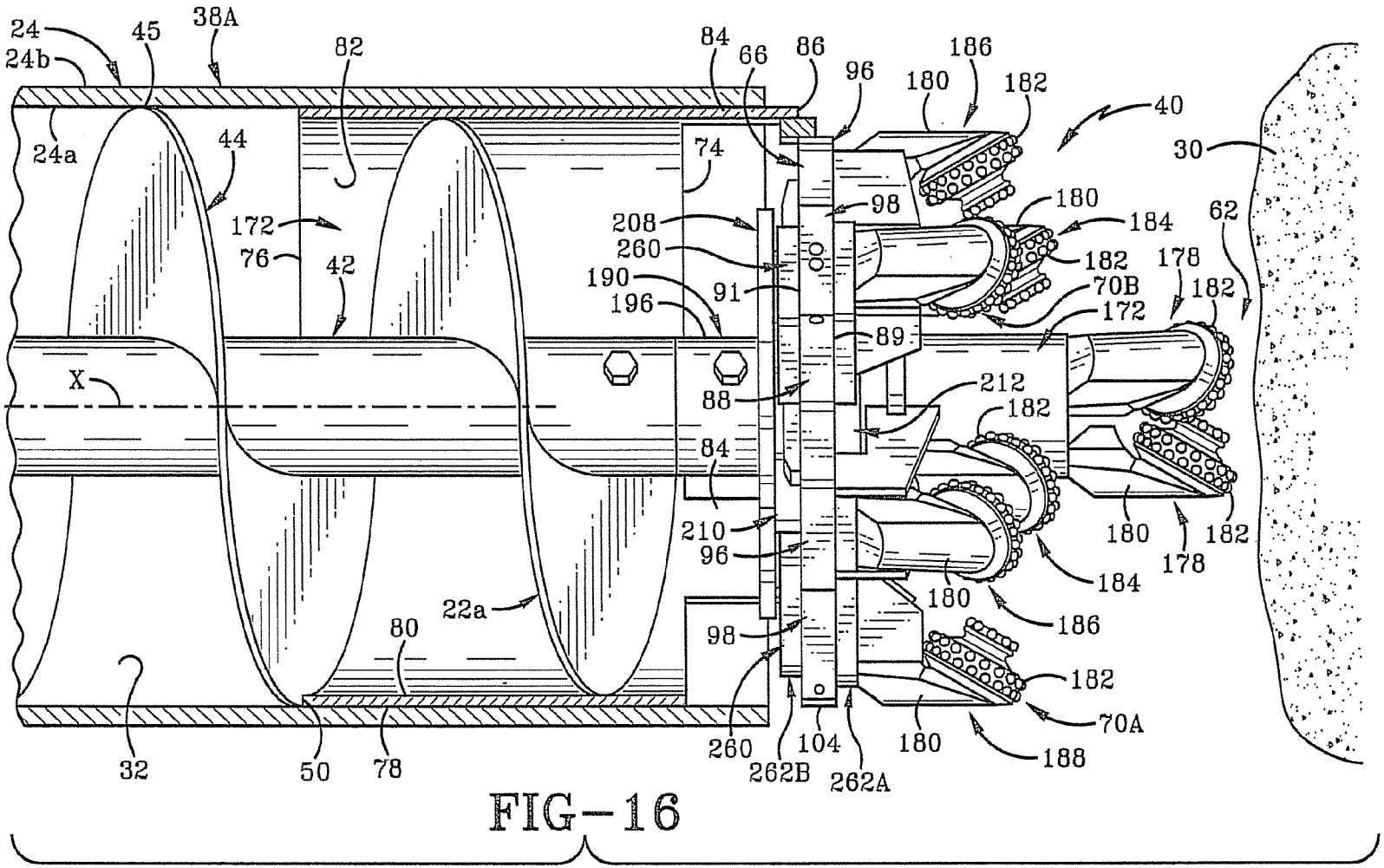
FIG. 16 is a side elevational view of the front end of the lead auger and the rock head in its collapsed position with the movable cutter assemblies forward of the front end of the underground pipe and the pilot cutters adjacent the underground rock to be cut.
Figure 17:
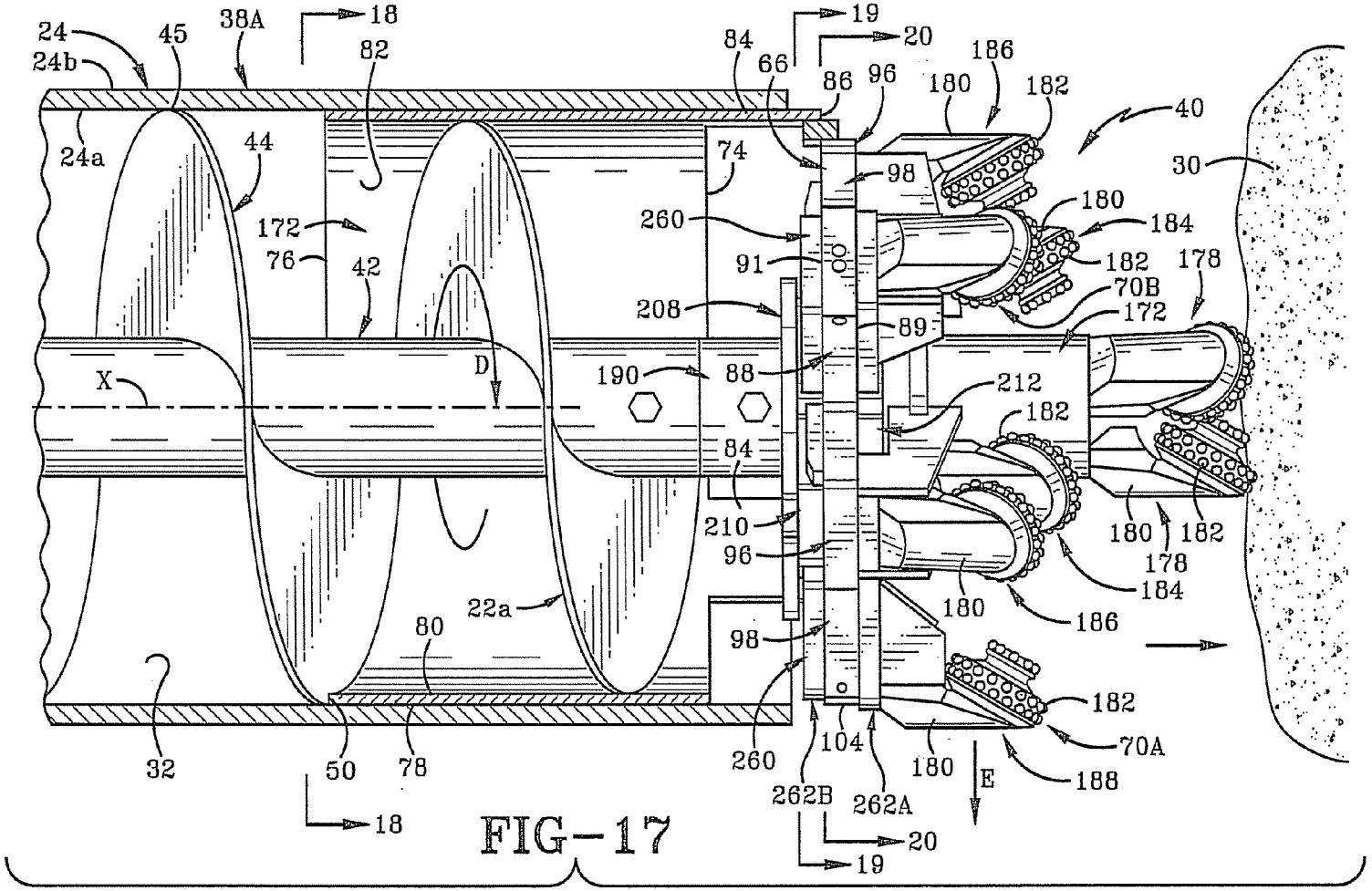
FIG. 17 is similar to FIG. 16 and shows the pilot cutters in contact with the rock, and the auger and drive section having been rotated to cause the rock head to move to its expanded position.

The operation of rock head 40 and the auger boring system of the present invention is now described with primary reference to FIGS. 15-21. After dirt head 26 has been removed from the front end 22*a* of auger 22, as previously discussed with reference to FIG. 2, auger segment 25 is connected at its rear end to the front end of the leading auger segment 27, replacing dirt head 26 and becoming the new leading auger segment. Rock head 40 is mounted on the front of leading segment 25, as noted above with reference to FIG. 14 so that rock head 40 and auger 22 may be advanced forward through bore 32 of pipe 24 as shown in FIG. 15. More particularly, FIG. 15 illustrates that auger boring machine 10 slides forward along tracks 12 to advance rock head 40 and auger 22 through pipe 24. FIG. 16 illustrates rock head 40 having advanced so that all components of rock head 40 which would in the expanded position extend radially outwardly beyond the inner diameter D1 of inner perimeter 24A of pipe 24 are positioned entirely forward of the front end of pipe 24. The advance of rock head 40 and auger 22 forward through pipe 24 as illustrated in FIGS. 15 and 16 is preferably done without forward rotation of auger 22 (without clockwise rotation about axis X as viewed looking forward) which would otherwise cause movable cutter sections 70A to move toward their expanded position while within pipe 24. Once these components have moved forward of the front end of pipe 24, the clockwise rotation of auger 22 and drive section 68 (Arrow D) about axis X causes the cutter sections 70 to slide radially outwardly (Arrows E) to the expanded position (FIG. 17). Bearing ring 72 remains within the front portion of bore 32 of pipe 24 during the expansion of rock head 40 and the subsequent cutting of rock 30 so that bearing ring 72 provides the primary support for the weight of rock head 40 via the relatively broad engagement of outer surface 78 with the inner surface 24*a* of pipe 24. The relatively large surface area of outer surface 78 substantially minimizes or eliminates the wear of the helical flight of auger 22 adjacent its front end which would otherwise occur as a result of the substantial weight of rock head 40 due to substantial friction via a sliding engagement between the relatively narrow helical terminal edge 45 and inner surface 24*a* of pipe 24 during rotation of the auger and rock head. As a result, bearing ring 72 substantially prevents the downward drift of rock head 40 during operation which would otherwise occur due to the wearing of the helical flights. During the initial forward rotation of auger 22 and drive section 68 about axis X, the frictional engagement between outer surface 78 of ring 72 and inner surface of 24*a* of pipe 24 and/or the frictional engagement of the pilot assemblies 178 with rock 30 sufficiently temporarily prevent rotation of base 66 in order to allow the relative rotation between drive section 68 and base 66 in order to cause the expansion of rock head 40.

Figure 5:
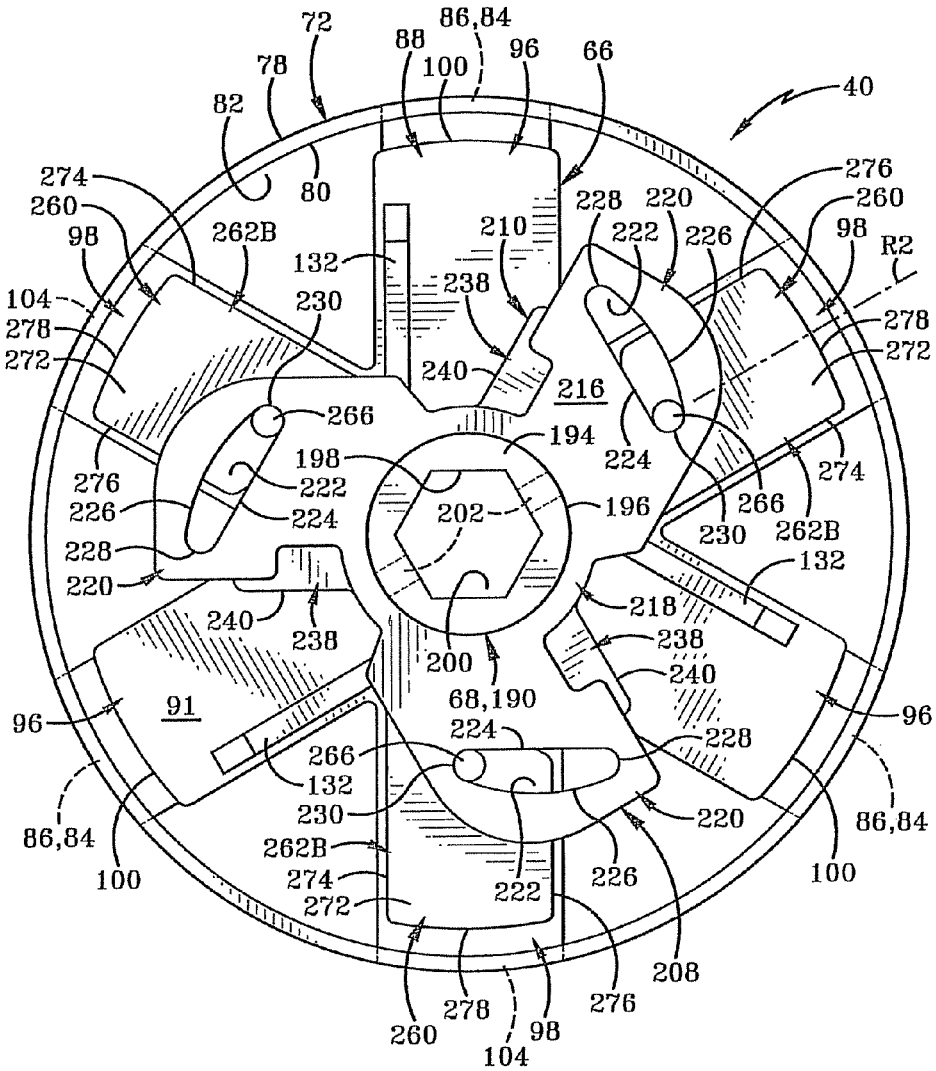
FIG. 5 is a rear end elevational view of the rock head taken on line 5-5 of FIG. 4.
Figure 18:
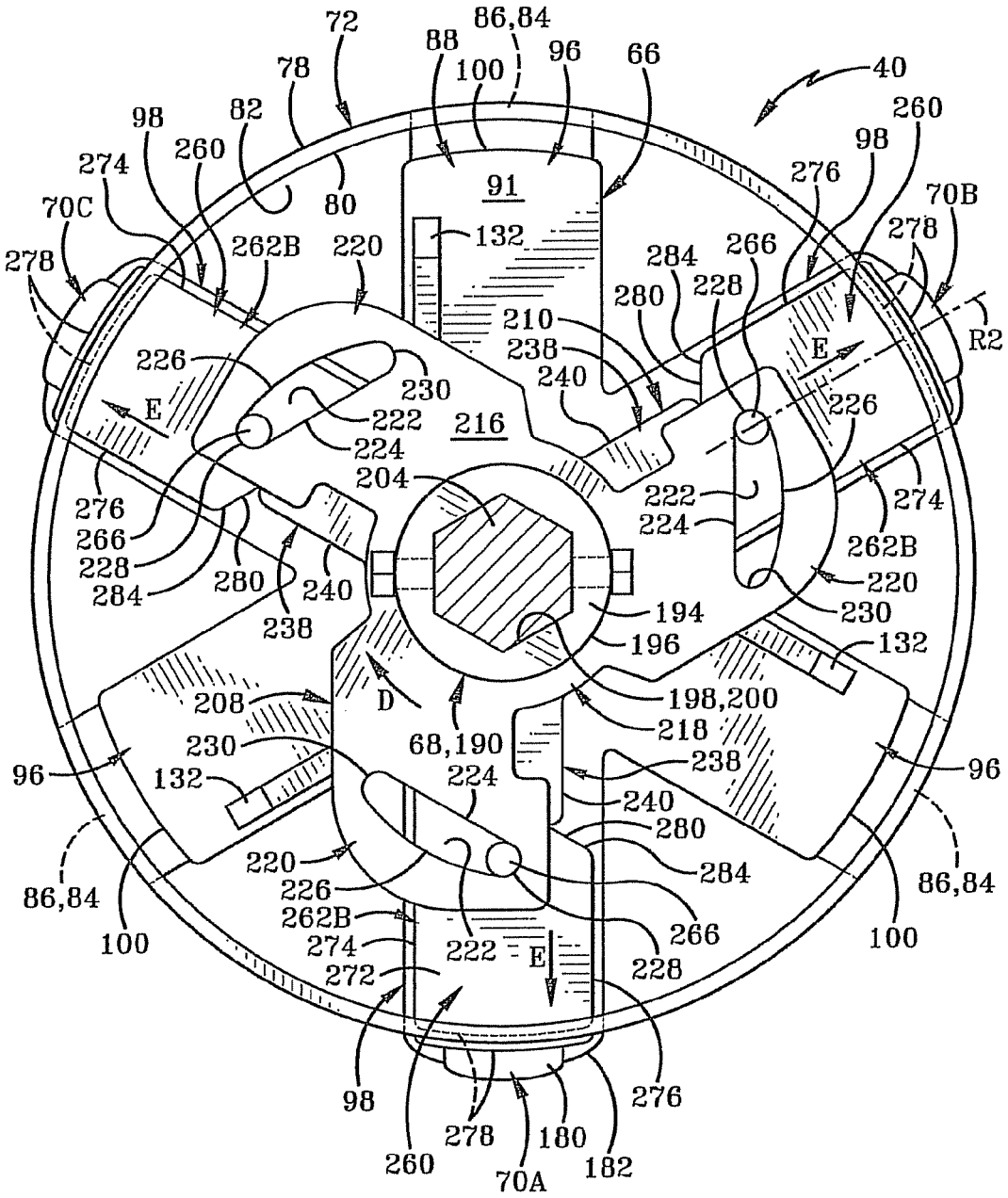
FIG. 18 is a sectional view similar to FIG. 5 taken on line 18-18 of FIG. 17 with the auger removed to show the rock head in the expanded position.
Figure 19:
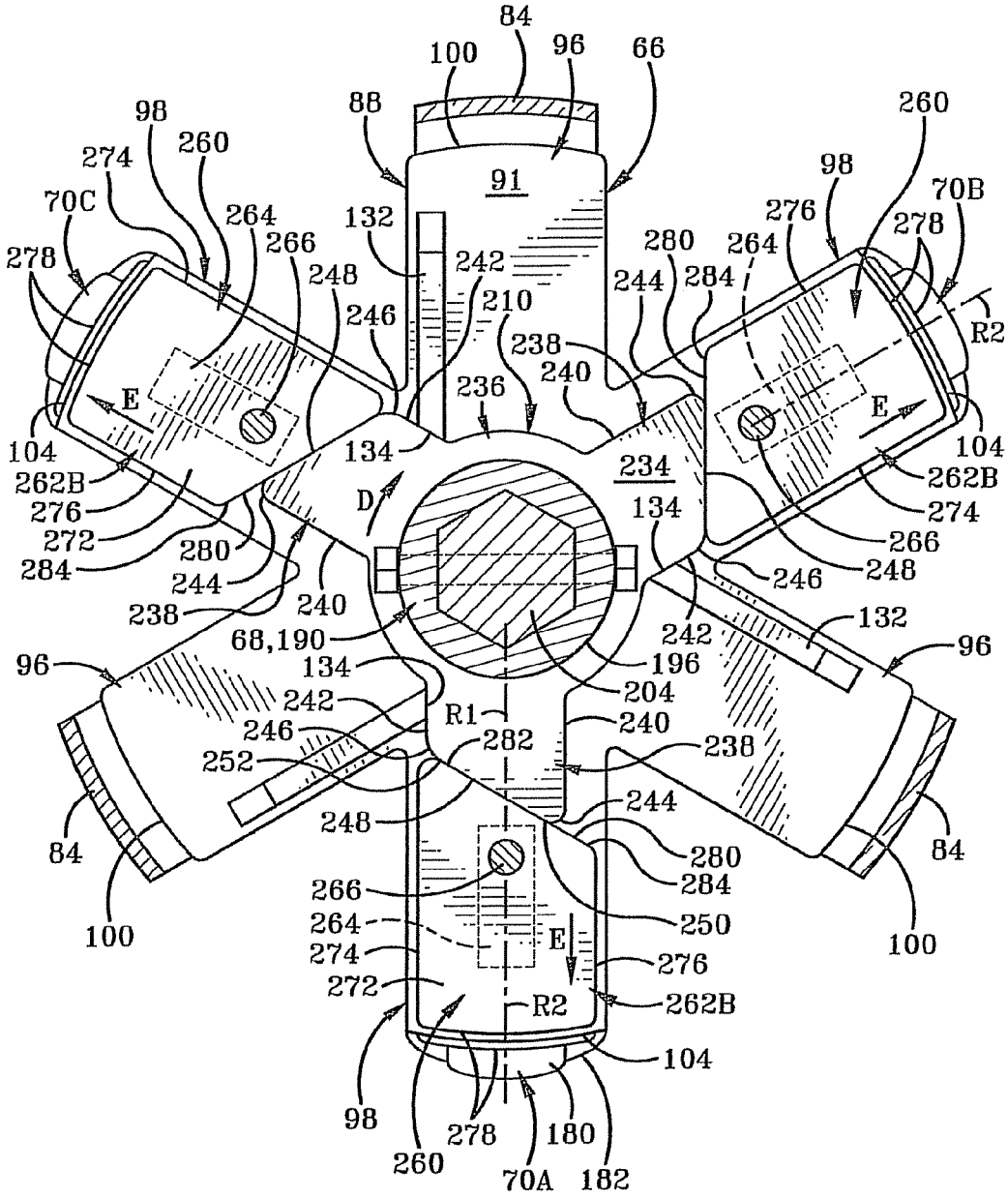
FIG. 19 is a sectional view similar to FIG. 6 taken on line 19-19 of FIG. 17 and shows the rock head in the expanded position.
Figure 20:
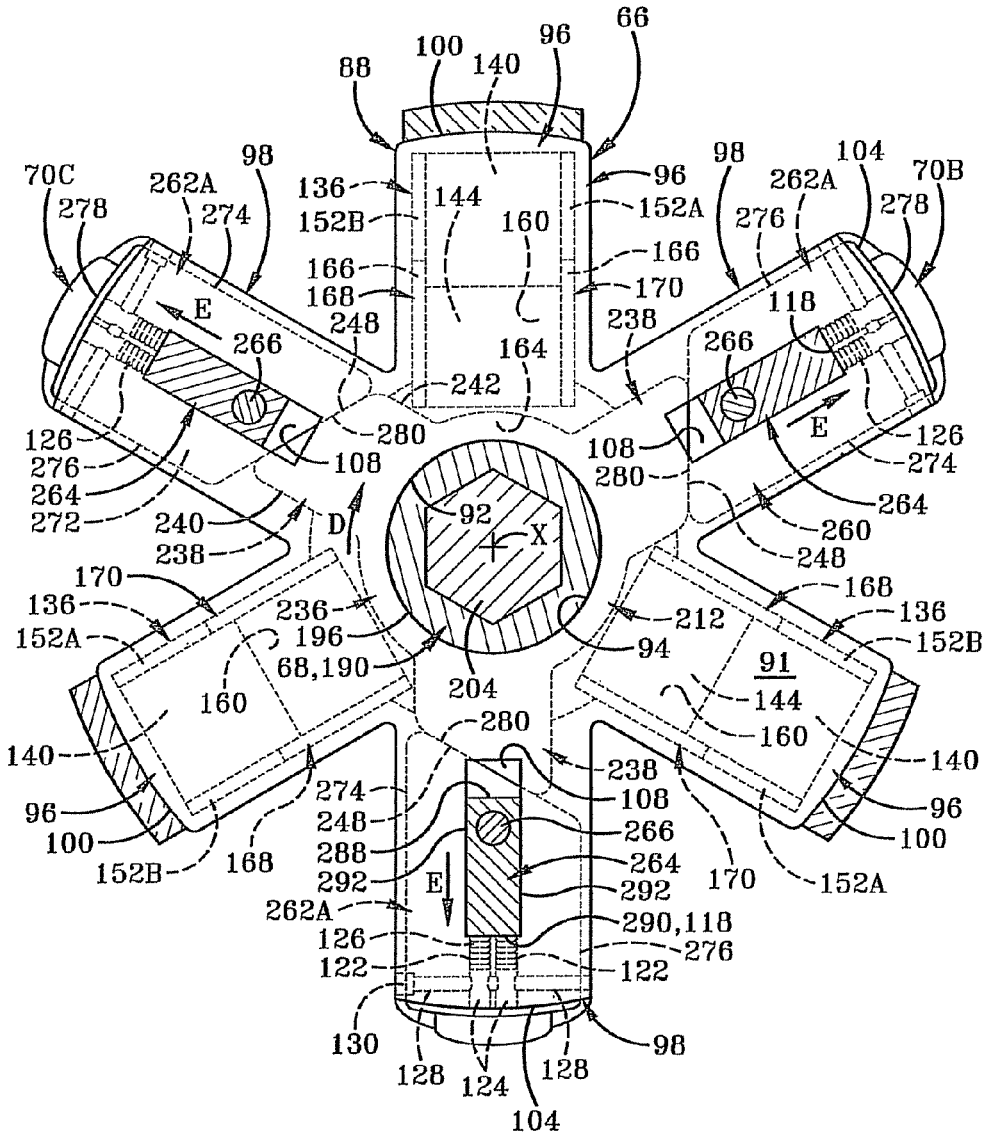
FIG. 20 is a sectional view similar to FIG. 7 taken on line 20-20 of FIG. 17 and shows the rock head in the expanded position.

FIGS. 18-20 are respectively similar to FIGS. 5-7 and show the expanded position of rock head 40. Comparison of FIGS. 18-20 to FIGS. 5-7 illustrates the movement of movable cutter sections 70 to the expanded position in response to the rotation of drive section 68 relative to base 66. This expansion is caused by the cam action between the various cam surfaces 248 of cam members 238 and the corresponding cam surfaces 280 of the cam followers 262A and 262B. In the collapsed position, the second end 252 of each cam surface 248 is circumferentially intermediate the first end 282 and second end 284 of the corresponding cam surface 280 adjacent surface 280 while the first end 250 is circumferentially spaced from second end 284 in a direction away from first end 282. During the rotation of drive section 68, cam surface 248 moves circumferentially so that second end 252 moves toward first end 282 and first end 250 moves toward second end 284 and then past second end 284 toward first end 282 as cam surface 248 slidably engages cam follower surface 280 whereby the rotational movement of drive section 68 is translated via the sliding cam engagement into radial outward movement of the respective cutter mount 260 to the expanded position. In the expanded position, second end 252 is adjacent first end 282 and first end 250 is adjacent second end 284. In the collapsed position in the exemplary embodiment, the entire cam surface 248 from first end 250 to second end 252 is in a continuous engagement with cam follower surface 280, and most of cam surface 280 is likewise in a continuous engagement with cam surface 248.

During the movement from the collapsed to the expanded position, key 264 slides within key way 108 radially outwardly against the spring bias of springs 126 (FIGS. 7, 20) whereby springs 126 move from a generally expanded position (FIG. 7) in which they nonetheless provide some tension or bias of the cutter mount toward the collapsed position to a substantially more compressed state, which may be fully compressed (FIG. 20) in the expanded position of rock head 40. Outer end 290 of key 264 may thus abut surface 118 and/or the inner ends of the spring mounts 124 in the expanded position. During the rotation of drive section 68 relative to the driven section, cam follower or post 266 moves from a position within slot 222 abutting end 230 thereof (FIG. 5) to a position abutting the opposite end 228 thereof (FIG. 18). Thus, end 230 may serve as a stop in the collapsed position of the rock head to prevent rotation of drive section 68 relative to base 66 in the counter clockwise direction, while end 228 may serve as a stop to prevent rotation of drive section 68 relative to base 66 in the forward clockwise direction as viewed from the rear. The rotation of drive section 68 relative to base 66 in the expanding direction also moves shorter contact surfaces 242 from a position which is out of contact with contact surfaces 134 (FIG. 6) to a position in which these surfaces are in contact with one another (FIG. 19) when rock head reaches the expanded position. The torque provided to drive section 68 from rotational drive 21 (FIG. 15) through auger 22 and torque drive connector 190 is thus transferred from contact surfaces 242 to surfaces 134 in order to drive rotation of the driven section of rock head 40, namely base 66 and movable cutter sections 70 along with the various rock cutter assemblies mounted on the driven section.

Figure 21:
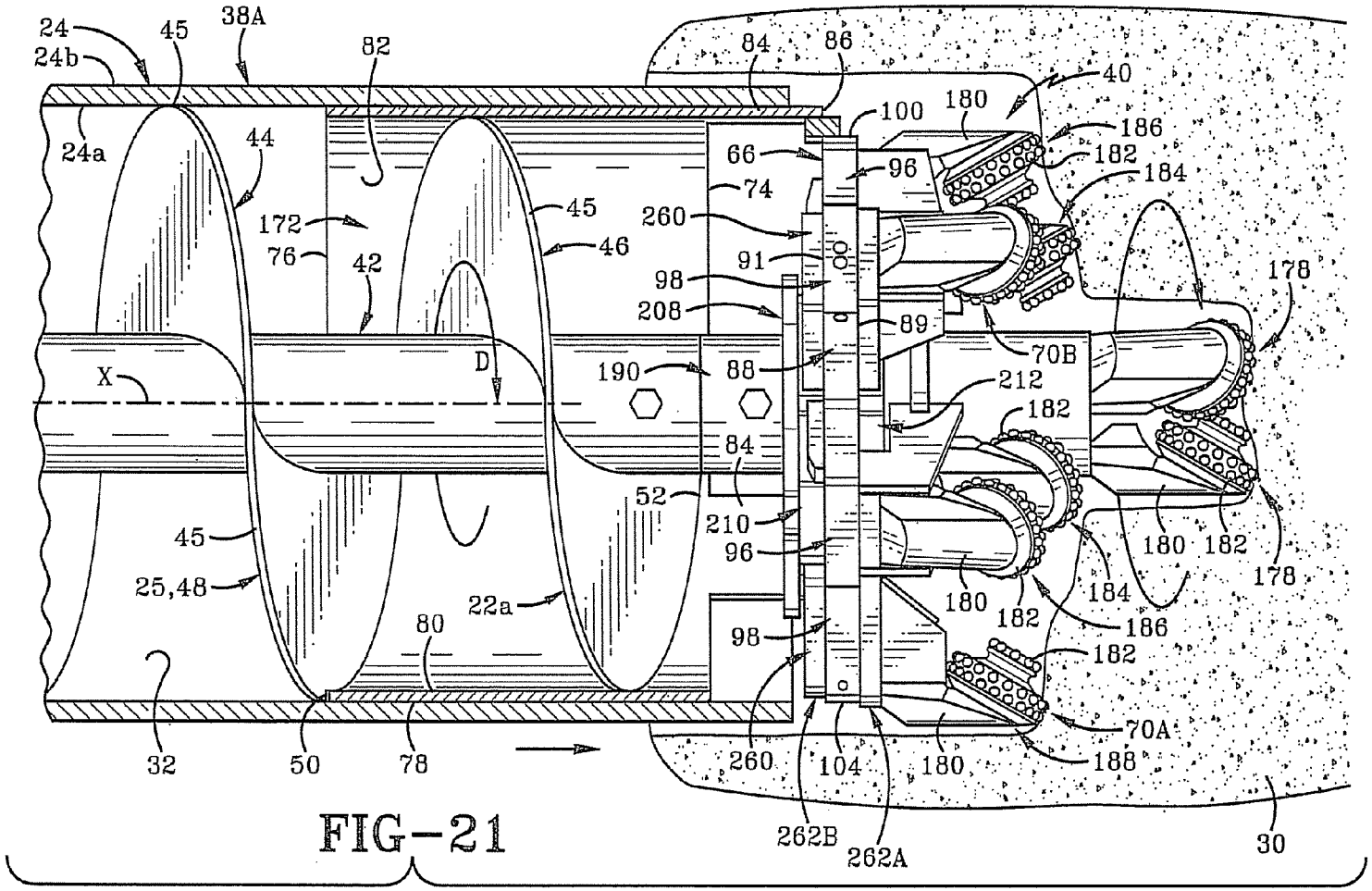
FIG. 21 is similar to FIG. 17 and shows the auger and entire rock head rotating to cut a hole in the underground rock with a portion of the underground pipe disposed in the hole.

Thus, once shorter contact surfaces 242 abut contact surfaces 134, the relative rotation between the drive section 68 and the driven section ceases and both sections, or the entire rock head 40, begins to rotate in the forward driving direction in order to begin boring a hole through rock 30. More particularly, the rock cutters 182 of pilot assemblies 178 cut a relatively smaller diameter hole, followed by a larger diameter hole cut by the rock cutters of assemblies 184 and 186, and an even larger diameter section cut by the rock cutters 182 of movable assemblies 188 (FIG. 21). The rock cutters of assemblies 178, 184 and 186 thus cut diameters which are smaller than diameter D6 (FIG. 4) of the inner surface 80 of ring 72, diameter D5 (FIG. 4) of outer surface 78, and respective diameters of the inner and outer surfaces of pipe 24, while the movable cutters of assemblies 188 extend partially radially outwardly beyond the outer surface 24*b* of pipe 24 in order to cut a larger diameter hole sufficiently big to receive pipe 24 therein as the entire boring assembly moves forward, including rock head 40, auger 22, pipe 24 and machine 10 as it slides along tracks 12 and pushes and rotates the auger and rock head while also pushing the pipe 24 non-rotationally forward.

Once the rock head has bored a hole through rock 30, the forward movement and rotation of auger 22 and rock head 40 will be stopped, after which boring machine 10 will be operated to rotate rotational drive 21 in the reverse direction (counter clockwise as viewed from the rear) to likewise rotate auger 22 in the reverse direction and drive section 68 in the reverse direction relative to the driven section of rock head 40 in order to move the rock head from its expanded position to its collapsed position. In the exemplary embodiment, two mechanisms are provided to facilitate this movement from the expanded to the collapsed position. Referring to FIGS. 5 and 18, the drive section 68 is rotated in the direction opposite arrow D in FIG. 18 so that cam surfaces 226 move circumferentially generally along the radial outer edge of cam followers 266 with a sliding engagement therebetween in order to urge or force followers 266 and cutter mounts 260 radially linearly inwardly in the opposite direction as described in the expansion and thus from the position of FIG. 18 to that of FIG. 5. In addition, springs 126 provide a radial inward movement against each key 264 in order to also facilitate the radial inward movement of movable cutter mounts 260 from the compressed position of springs 126 in FIG. 20 to the relatively uncompressed or more extended position shown in FIG. 7. Once the rock head is moved to the collapsed position, boring machine 10 is then slid rearwardly along tracks 12 in order to withdraw the auger and rock head through bore 32 of pipe 24. Auger segments 27 are sequentially disconnected from the rotational drive 21 and other auger segments to which they are connected so that a given auger segment may be removed whereby machine 10 can then slide forward on tracks 12 to reconnect to another auger segment and then move rearwardly to further withdraw the auger segments and rock head until the rock head is completely removed rearwardly from pipe 24, and thus in the reverse direction shown in FIG. 15. The dirt head 26 can then be reconnected to the front end of the auger 22 and reinserted through pipe 24 beyond rock 30 in order to continue cutting the soil or other material for which dirt head 26 operates much more efficiently than rock head 40.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a base of the cutter bit;

a plurality of rock cutters configured for cutting rock when the cutter bit is rotated about the axis;

a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position; and a drive section of the cutter bit adapted to be rotationally driven by an auger having a helical flight; and wherein the movable cutter mounts move radially in response to rotation of the drive section about the axis relative to the base.

2. The apparatus of claim 1, further comprising:

a plurality of springs which respectively bias the movable cutter mounts radially inwardly toward the collapsed position.

3. The apparatus of claim 2 further comprising a plurality of radially elongated keyways defined by one of (a) the base and (b) the cutter mounts respectively; and a plurality of keys formed on the other of the base and the cutter mounts respectively so that each key is radially slidable within a respective one of the keyways during movement of the cutter mounts between the collapsed and expanded positions; wherein the springs are respectively in the keyways.

4. The apparatus of claim 1 wherein the springs are respectively adjacent the cutter mounts.

5. The apparatus of claim 4 further comprising a plurality of spring mounts on the base; wherein each of the springs has a radial inner end and a radial outer end so that the radial inner ends respectively abut the cutter mounts and the radial outer ends respectively abut the spring mounts.

6. The apparatus of claim 1 further comprising a central portion of the drive section; a plurality of arms which are rigidly secured to and extend radially outwardly from the central portion; and an engagement between the arms and the cutter mounts respectively during rotation of the drive section about the axis relative to the base such that the rotation causes radial movement of the cutter mounts via the engagement.

7. The apparatus of claim 6 further comprising a central portion of the base; and a plurality of arms which are rigidly secured to and extend radially outwardly from the central portion of the base and which respectively carry the movable mounts.

8. The apparatus of claim 1, further comprising:

a plurality of radially elongated keyways defined by one of (a) the base and (b) the cutter mounts respectively;

a plurality of keys formed on the other of the base and the cutter mounts respectively so that each key is radially slidable within a respective one of the keyways during movement of the cutter mounts between the collapsed and expanded positions;

a rearward-facing surface on the base;

a forward-facing surface on the base which is forward of the rearward-facing surface;

a forward-facing surface on each of the cutter mounts adjacent and facing the rearward-facing surface of the base; and a rearward-facing surface on each of the cutter mounts adjacent and facing the forward-facing surface of the base.

9. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a base of the cutter bit;

a plurality of rock cutters configured for cutting rock when the cutter bit is rotated about the axis;

a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position;

a plurality of first cam surfaces respectively on the movable cutter mounts;

a plurality of second cam surfaces on the cutter bit;

a sliding engagement between the first cam surfaces and the second cam surfaces respectively during movement of the second cam surfaces relative to the base which causes the movable cutter mounts to move radially;

a plurality of cutter mounts which are fixed relative to the base;

a cutter carried by each of the fixed cutter mounts; and a space defined between each fixed cutter mount and the base; and wherein the second cam surfaces are disposed respectively in the spaces in the collapsed position.

10. The apparatus of claim 9 wherein the sliding engagement causes the movable cutter mounts to move radially outwardly.

11. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a base of the cutter bit;

a plurality of rock cutters configured for cutting rock when the cutter bit is rotated about the axis;

a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position;

a plurality of first cam surfaces respectively on the movable cutter mounts;

a plurality of second cam surfaces on the cutter bit;

a sliding engagement between the first cam surfaces and the second cam surfaces respectively during movement of the second cam surfaces relative to the base which causes the movable cutter mounts to move radially;

a plurality of cutter mounts which are fixed relative to the base;

a cutter carried by each of the fixed cutter mounts;

a space defined between each fixed cutter mount and the base; and a plurality of cam members which respectively define the second cam surfaces; and wherein the cam members are disposed respectively in the spaces in the collapsed position.

12. The apparatus of claim 11 wherein the sliding engagement causes the movable cutter mounts to move radially inwardly.

13. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a base of the cutter bit;

a plurality of rock cutters configured for cutting rock when the cutter bit is rotated about the axis;

a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position;

a plurality of first cam surfaces respectively on the movable cutter mounts;

a plurality of second cam surfaces on the cutter bit;

a sliding engagement between the first cam surfaces and the second cam surfaces respectively during movement of the second cam surfaces relative to the base which causes the movable cutter mounts to move radially a drive section of the cutter bit;

a central portion of the drive section; and a plurality of arms which are rigidly secured to and extend radially outwardly from the central portion and which respectively define the second cam surfaces; and wherein the sliding engagement occurs during rotation of the drive section about the axis relative to the base.

14. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a base of the cutter bit;

a plurality of rock cutters configured for cutting rock when the cutter bit is rotated about the axis;

a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position;

a drive section of the cutter bit;

a rearward-facing surface on the base;

a forward-facing surface on the base which is forward of the rearward-facing surface;

a first cam surface on each movable cutter mount rearward of the rearward-facing surface;

a second cam surface on each movable cutter mount forward of the forward-facing surface;

a third cam surface on the drive section;

a fourth cam surface on the drive section;

a first sliding engagement between the first and third cam surfaces during rotation of the drive section relative to the base about the axis; and a second sliding engagement between the second and fourth cam surfaces during rotation of the drive section relative to the base about the axis;

wherein the first sliding engagement and second sliding engagement cause the respective movable cutter mount to move radially.

15. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a base of the cutter bit;

a plurality of rock cutters configured for cutting rock when the cutter bit is rotated about the axis;

a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position;

an auger which is connected to the cutter bit and extends rearwardly therefrom such that rotation of the auger drives rotation of the cutter bit; the auger comprising a shaft and a helical flight secured to and extending radially outwardly from the shaft;

a bearing ring of the cutter bit having a cylindrical outer surface adapted to slidably engage the cylindrical inner surface of the casing during rotation of the cutter bit whereby the bearing ring is adapted to support the cutter bit within the casing;

a front section of the flight disposed within and rotatable relative to the bearing ring; and a rear section of the flight rearward of the bearing ring and adapted to rotate within the casing when the auger is disposed therein and the rock cutters are forward of the casing.

16. The apparatus of claim 15 wherein the bearing ring has a cylindrical inner surface of a second inner diameter; the front section of the flight has a front end, a back end and a helical terminal edge which has a constant first outer diameter concentric about the axis from the front end to the back end; the helical terminal edge of the front section is adjacent the cylindrical inner surface of the bearing ring; the rear section of the flight has a front end, a back end and a helical terminal edge which has a constant second outer diameter concentric about the axis from the front end of the rear section to the back end of the rear section; and the second outer diameter is smaller than the first inner diameter and larger than the second inner diameter whereby the helical terminal edge of the rear section is adapted to rotate adjacent the cylindrical inner surface of the casing when the auger is disposed therein and the rock cutters are forward of the casing.

17. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a base of the cutter bit;

a plurality of rock cutters configured for cutting rock when the cutter bit is rotated about the axis;

a plurality of movable cutter mounts each of which is mounted on the base, carries one of the cutters and is non-pivotally movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position; and a rigid wiper which is disposed circumferentially between a pair of the cutters and has a leading face which faces circumferentially and rearwardly whereby the leading face is adapted to facilitate movement of pieces of rock cut by the cutter heads rearwardly during rotation of the cutter bit about the axis.

18. An apparatus comprising:

a cutter bit which has front and rear ends defining therebetween an axial direction and which rotates during operation about an axis which extends in the axial direction; the cutter bit adapted to rotate within an underground casing having a cylindrical inner surface of a first inner diameter;

a drive section of the cutter bit;

a base of the cutter bit;

a plurality of rock cutters configured for cutting rock when the cutter bit is rotated about the axis;

a plurality of movable cutter mounts each of which is mounted on the base, carries one of the cutters and is movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position;

a plurality of circumferentially elongated first cam surfaces;

a plurality of second cam surfaces; and a sliding engagement between the first cam surfaces and the second cam surfaces respectively during rotation of the drive section relative to the base about the axis which causes the movable cutter mounts to move radially.

19. An apparatus comprising:

a cutter bit which has front and rear ends defining therebetween an axial direction and which rotates during operation about an axis which extends in the axial direction; the cutter bit adapted to rotate within a cylindrical casing having a cylindrical inner surface of a first inner diameter;

a plurality of rock cutters configured for cutting rock when the cutter bit is rotated about the axis;

a base of the cutter bit;

a plurality of movable cutter mounts each of which is mounted on the base, carries one of the cutters and is movable radially inwardly and outwardly between a collapsed position in which the respective cutter is entirely radially inward of the first inner diameter and an expanded position in which the respective cutter is at least partially radially outward of the first inner diameter whereby the cutter bit is adapted to be withdrawn through the casing in the collapsed position and to cut rock forward of the casing in the expanded position;

a plurality of radially elongated keyways defined by one of (a) the base and (b) the cutter mounts respectively;

a plurality of keys formed on the other of the base and the cutter mounts respectively so that each key is radially slidable within a respective one of the keyways during movement of the cutter mounts between the collapsed and expanded positions;

a rearward-facing surface on the base; and a forward-facing surface on the base which is forward of the rearward-facing surface; and wherein the keyways are defined by the base and extend from the forward-facing surface to the rearward-facing surface.

20. The apparatus of claim 19 wherein each key has front and rear ends; each cutter mount comprises a front plate secured to the front end of the respective key and a rear plate secured to the rear end of the respective key; and each of the front and rear plates is circumferentially wider than the respective keyway.

21. The apparatus of claim 19 further comprising a forward-facing surface on each of the cutter mounts adjacent and facing the rearward-facing surface of the base; and a rearward-facing surface on each of the cutter mounts adjacent and facing the forward-facing surface of the base.

* * * * *